US006962608B1

(12) United States Patent
Sun et al.

(10) Patent No.: US 6,962,608 B1
(45) Date of Patent: Nov. 8, 2005

(54) REGENERABLE ANTIMICROBIAL POLYMERS AND FIBERS WITH OXYGEN BLEACHES

(75) Inventors: Gang Sun, Davis, CA (US); Louise Ko Huang, Hamden, CT (US)

(73) Assignee: The Regents of the University of California, Oakland, CA (US)

( * ) Notice: Subject to any disclaimer, the term of this patent is extended or adjusted under 35 U.S.C. 154(b) by 59 days.

(21) Appl. No.: 10/674,764

(22) Filed: Sep. 29, 2003

Related U.S. Application Data

(60) Provisional application No. 60/415,482, filed on Oct. 1, 2002.

(51) Int. Cl.[7] ..... D06M 13/192; D06M 13/196

(52) U.S. Cl. ..... 8/115.69; 8/115.56; 8/128.1; 8/115.51

(58) Field of Search ..... 8/115.51, 115.56, 8/115.69, 128.1; 442/123–224

(56) References Cited

U.S. PATENT DOCUMENTS

| | | | |
|---|---|---|---|
| 2,950,553 | A | 8/1960 | Hurwitz |
| 3,285,928 | A | 11/1966 | Gubitz |
| 3,565,824 | A | 2/1971 | Pierce et al. |
| 3,643,270 | A | 2/1972 | Kirschnek et al. |
| 3,812,201 | A | 5/1974 | Bey |
| 3,817,702 | A | 6/1974 | Paulus et al. |
| 3,876,657 | A | 4/1975 | Aelony et al. |
| 3,971,757 | A | 7/1976 | Rasberger |
| 4,091,223 | A | 5/1978 | Zussman et al. |
| 4,241,208 | A | 12/1980 | Higashida et al. |
| 4,272,622 | A | 6/1981 | Kitamura et al. |
| 4,311,479 | A | 1/1982 | Fenn et al. |
| 4,407,748 | A | 10/1983 | Gorbacheva et al. |
| 5,026,546 | A | 6/1991 | Hilgers et al. |
| 5,059,420 | A | 10/1991 | Scholla et al. |
| 5,130,035 | A | 7/1992 | Dell'Anno et al. |
| 5,459,145 | A | 10/1995 | Saccomano et al. |
| 5,490,983 | A | 2/1996 | Worley et al. |
| 5,855,623 | A | 1/1999 | English et al. |
| 5,882,357 | A | 3/1999 | Sun et al. |
| 6,020,491 | A | 2/2000 | Chen et al. |
| 6,077,319 | A | 6/2000 | Sun et al. |
| 6,241,783 | B1 | 6/2001 | Sun |
| 6,436,419 | B1 | 8/2002 | Sun et al. |
| 2003/0159200 | A1 * | 8/2003 | Elrod ..... 2/456 |

FOREIGN PATENT DOCUMENTS

| | | | |
|---|---|---|---|
| DE | 19 00 169 | A | 9/1969 |
| DE | 89 846 | A | 5/1972 |
| DE | 24 37 916 | A | 2/1976 |
| DE | 24 37 917 | A | 2/1976 |
| DE | 2 734 618 | A | 2/1978 |
| EP | 0 240 370 | A | 10/1987 |
| FR | 1499788 | A | 1/1968 |

(Continued)

OTHER PUBLICATIONS

Aelony, D. et al., "Aminimides. IX. General synthesis of 1-substituted-2-imidazolidinones" (Abstract) J. Heterocycl. Chem., 9(3):687-90 (1972) & STN Database Accession No. 77:88393.

(Continued)

*Primary Examiner*—Margaret Einsmann
(74) *Attorney, Agent, or Firm*—Townsend and Townsend and Crew LLP

(57) ABSTRACT

The present invention provides durable and regenerable antimicrobial fibers and methods for preparing the same. These fibers have excellent colorfastness and washfastness, and are environmentally friendly. The antimicrobial fibers of this invention are suitable for a variety of purposes, including medical uses, sportswear, and uniforms.

27 Claims, 24 Drawing Sheets

FOREIGN PATENT DOCUMENTS

| | | | |
|---|---|---|---|
| GB | 1 474 482 | A3 | 5/1977 |
| GB | 2161399 | A | 1/1986 |
| JP | 07102209 | A | 4/1995 |
| JP | 08269072 | A | 10/1996 |
| JP | 2000073280 | A | 3/2000 |
| WO | WO 94/20118 | A | 9/1994 |
| WO | WO 96/08949 | A | 3/1996 |
| WO | WO 00/15897 | A1 | 3/2000 |
| WO | WO 01/14629 | A1 | 3/2001 |
| WO | WO 01/15778 | A1 | 3/2001 |
| WO | WO 01/72715 | A2 | 10/2001 |
| WO | WO 01/97617 | A1 | 12/2001 |
| WO | WO 02/22923 | A2 | 3/2002 |

OTHER PUBLICATIONS

Bogatyreva, L. et al., "Wrinkleproof finishing of cotton blended fabrics" (Abstract) Khlopchatobum. Prom. 31(2): 71-9 (1971) & Chem. Abstr., vol. 78, No. 12, Mar. 26, 1973, p. 66, Abstract No. 73517u.

Cho, J. et al., "Effect of a dual functiion finish containing an antibiotic and a fluorochemical on the antimicrobial properties and blood repellency of surgical grown materials" Textile Res. J. 67(12):875-880 (1997).

Eckhardt, C. et al., "UV Protector for Cotton Fabrics" Textile Chemist and Colorist & American Dyestuff Reporter 32(4):21-23 (2000).

Hennion, G. et al., "Substituted acetylenes. LXXXVI. Synthesis and reactions of some polysubstituted 2-imidazolidinones" (Abstract) J. Org. Chem. 32(9):2819-22 (1967) & STN Database Accession No. 67:90720.

Keping et al., "Laboratory Research on Shielding Effect of a Novel Conductive Cloth to Microwave Radiation" Journal of Electrostatistics 44:125-129 (1998).

Kim et al., "Preparation of bis-quatemary ammonium salls from epichlorohydrin" JAOCS 73(1):67-71 (1996).

Kim et al., "Dye Molecules as Bridges for Functional Modifications of Nylon: Antimicrobial Functions" Textile Res. J. 70(8):728-733 (2000).

Kim et al., "Durable antimicrobial finishing of nylon fabrics with acid dyes and a quatemary ammonium salt" Textile Res. J. 71(4):318-323 (2001).

Ko, L. et al., "A Novel Detoxifying Pesticide Protective Clothing for Agricultural Workers" Textile Chemist and Colorist & American Dyestuff Reporter 32(2):34-38 (2000).

Oldfield, W. et al., "The chemistry and pharmacology of a series of cycloalkanespiro-5'-hydantoins" J. Med. Chem. 8(2):239-49 (1965).

Payne et al., "A durable antiodor finish for cotton textiles" Textile Chemist and Colorist 26(5):28-30 (1996).

Pedregal, C. et al., "Etude de quelques derives N-3-substitues et N-1,N-3-disubstitues de la cyclohexanospiro-hydantoine" J. Hetero. Chem. 21(2):477-480 (1984).

Piottukh Peletsky, V. N. et al., "Which IR search system is better for selection of unknown structure analogues?" (Abstract) Anal. Chim. Acta, 396(1):99-103 (1999) & STN Database Accession No. 131:294929.

Rigby, A. et al., "Medical textiles. Textile materials in medicine and surgery" Textile Horizons pp. 42-46 (1993).

Scott et al., "The survival and transfer of microbial contamination vis cloths, hands and utensils" J. Applied Bacteriology 68:271-278 (1990).

Sun et al., "Durable and Regenerable Antibacterial Finishing of Fabrics: Biocidal Properties" Textile CHemist and Colorist 30(6):26-30 (1998).

Sun et al., "Durable and regenerable antibacterial finishing of fabrics: chemical structures" Textile Chemist and Colorist 31(5):31-35 (1999).

Sun et al., "Durable and regenerable antibacterial finishing of fabrics: fabric properties" Textile Chemist and Colorist 31(1):21-24 (1999).

Sun, Y. et al., "Novel N-halamine polymeric biocides: synthesis and antibacterial activity of hydantoin-containing polymers" (Abstract) Polym. Prepr. (Am. Chem. Soc. Div. Polym. Chem.) 41(1):270 271 (2000) & STN Database Accession No. 133:79161.

Sun, Y. et al., "Novel regenerable N-halamine polymeric biocides. I. Synthesis, characterization, and antibacterial activity of hydantoin-containing polymers" J. Appl. Polym. Sci., 80(13):2460-2467 (2001).

Yang et al., "Durability of some antibacterial treatments to repeated home launderings" Textile Chemist and COlorist & American Dyestuff Reporter 32(4):44-49 (2000).

* cited by examiner

REGENERABLE ANTIMICROBIAL POLYMERS AND FIBERS WITH OXYGEN BLEACHES

CROSS-REFERENCE TO RELATED APPLICATIONS

This application claims priority to U.S. Patent Application No. 60/415,482, filed Oct. 1, 2002, the teachings of which are hereby incorporated by reference in its entirety for all purposes.

STATEMENT AS TO RIGHTS TO INVENTIONS MADE UNDER FEDERALLY SPONSORED RESEARCH AND DEVELOPMENT

The research carried out in this application was supported in part by a grant from the National Science Foundation (NSF #DMI 9733981). The government may have certain rights in any patent issuing from this application.

BACKGROUND OF THE INVENTION

Antimicrobial materials such as fabrics, fibers, polymers and even children's toys have become increasingly popular due to public concerns over epidemiological diseases and pathogens. With respect to antimicrobial fabrics, domestic and international markets have grown significantly as a result of public awareness of these potential threats (see, Center for Disease Control and Prevention, *Infection Control and Biosafety, Medical Data International. Report #RP-701530*, 1992; and A. J. Rigby, et al., Fiber Horizons, December 1993, 42–460). Antimicrobial clothing can be used in medicine as well as other institutional uses for such applications as, surgeon's gowns, caps, masks, patient drapes, bandages, wipers and cover cloths of various sizes.

Although the demand for antimicrobial fibers is high, few of such fibers are available, especially ones that are effective against a broad spectrum of bacteria and, which are effective after multiple machine washes. Research and development of durable functional fibers has been active in recent years, with new methods of incorporating antibiotics as bactericidal agents into polymers being advanced.

There are two major pathways to chemically achieve durable antibacterial effects. In one pathway, the slow-releasing of biocides through contact with the processed fabrics is employed. In this pathway, a pathway widely used around the world, sufficient chemical agents are impregnated onto the fibers by either chemical or physical methods. Thereafter, the biocides are slowly released from the processed fabrics into the media, thereby contacting and inhibiting the growth of microorganisms. Unfortunately, such chemical agents can be washed away easily if they are not covalently impregnated onto the surface of the fabrics. Moreover, the antibacterial functions are non-regenerable.

In the second pathway, a more innovative technology is employed which involves chemical modification of fibers with biocidal or potential biocidal compounds, wherein the antibacterial properties of such compounds are regenerable with a simple washing. The potential antibacterial groups can be rendered biocidal after washing with certain common chemicals, such as diluted bleaching solutions. U.S. Pat. No. 5,882,357, filed Sep. 13, 1996, describes durable and regenerable cellulose materials by using an innovative chemical finishing method. In that invention, treatment of cotton and polyester/cotton fabrics were finished by hydantoin derivatives, and biocidal properties were conferred by washing the treated fabrics with a chlorine laundry bleach. Chlorination of amide and imide bonds in hydantoin rings produce biocidal N-halamine sites. The N-halamine return to their precursor forms when the sites are exposed to microorganisms. The biocidal properties of the fibers can then be regenerated by using chlorine bleach. The major advantages of this chlorine regenerable finishing method are its durability, convenience and economy.

N-halamine chemistry, however, is not applicable to colorized fabrics. The use of chlorine bleach decolorizes fibers. Thus, a non-bleach regenerating agent would be desirable for certain applications, especially for colored materials.

In view of the foregoing, there exists a need in the art for durable and regenerable microbiocidal fibers that do not pose environmental concerns and are not limited to white fabrics. The present invention remedies such need by providing, inter alia, environmentally friendly, durable and regenerable microbiocidal colored fibers. Peroxycarboxylic acids have been applied on natural materials, and materials derived from natural materials. These compounds are soluble in water, so an aqueous finishing process is adopted. The chemicals were padded on fabrics, and then dried and cured at elevated temperatures. The biocidal properties of finished fibers have been evaluated against bacteria such as *Escherichia coli.* and *Staphylococcus aureus.*

SUMMARY OF THE INVENTION

The present invention provides, inter alia, durable and regenerable microbiocidal fibers and methods for preparing same. Such fibers can be readily prepared using a wet finishing process to covalently attach a peroxycarboxylic acid functional group to a cellulose based material or other polymeric material. Once prepared, the fibers of the present invention have a broad spectrum of biocidal activity against pathogenic microorganisms. Moreover, the biocidal activity of such fibers can be regenerated by way of peroxy compounds.

In one embodiment, the invention provides a fiber composition, the fiber composition comprising: a fiber; and a peroxycarboxylic acid functional group covalently attached to the fiber.

In one aspect, the fiber is cellulosic, cellulosic-polyester, or polyester material. In another aspect the cellulosic material is cotton or a cotton-polyester blend. In certain aspects, the peroxycarboxylic acid functional group is derived from an organic acid such as a monocarboxylic acid. In one preferred embodiment, the organic acid has at least two carboxyl groups, such as a tetracarboxylic acid, a tricarboxylic acid or a dicarboxylic acid. In another aspect, the organic acid is a butane tetraacetic acid or citric acid. In another aspect, the peroxycarboxylic acid functional group is derived from a polymer having a carboxylic acid function, such as at least two carboxylic acid functions. In another aspect, the peroxycarboxylic acid function group is at least two peroxycarboxylic acid functional groups.

In yet another embodiment, the present invention provides a process for preparing an antimicrobial fiber, the process comprising: (a) immersing a fiber in an aqueous treating solution comprising an organic acid having at least two carboxylic acid functions; and (b) treating the fiber with an oxidizing agent to produce a percarboxylic acid function, thereby preparing an antimicrobial fiber.

In one aspect, the aqueous treating solution further comprises a catalyst, such as an acid catalyst (e.g., sulfuric acid, methanesulfonic acid, sulfonic acid, or the like). In another aspect, the catalyst is an ion-exchange resin. In yet another aspect, the catalyst is sodium hydroxide or potassium hydroxide. In another aspect, the organic acid is butane tetraacetic acid or citric acid. In still another aspect, the process further comprises removing any excess treating solution from the fiber prior to treating the fiber with an oxidizing agent. In one aspect, the oxidizing agent is an aqueous solution of hydrogen peroxide. A suitable hydrogen peroxide solution is about 0.5% to about 30% by weight. In another aspect, the oxidizing agent is an oxygen bleach, such as hydrogen peroxide or sodium perborate.

In still another aspect, the fiber is an article, such as a surgeon's gown, a cap, a mask, a surgical cover, a patient drape, a carpeting, a bedding material, an underwear, a sock, a bandage, a pad, a sheet or a uniform.

In another aspect, the fiber is cellulosic material, such as cotton, rayon, tencel, flax, hemp, or blends of fibers with polyester or nylon. In another aspect, the fiber is chitosan or a chitin material. In another aspect, the antimicrobial activity is regenerable.

There are a myriad of applications areas for the microbiocidal fibers of the present invention. For instance, the microbiocidal fibers can provide biocidal protective clothing to personnel in the medical area as well as in the related healthcare and hygiene area. In contrast to previously used fibers, the fibers of the present invention are not a barrier to microorganisms, but rather a disinfectant to them. As such, the regenerable and reusable biocidal materials can replace currently used disposable, nonwoven fabrics as medical fibers, thereby significantly reducing hospital maintenance costs and disposal fees. The microbiocidal properties of the fibers of the present invention can be advantageously used for women's wear, underwear, socks, and other hygienic purposes. In addition, the microbiocidal properties can be imparted to carpeting materials to create odor-free and germ-free carpets. Moreover, all germ-free environments, such as required in biotechnology and pharmaceutical industry, can benefit from the use of the microbiocidal fibers of the present invention to prevent any contamination from air, liquid, and solid media.

Other features, objects and advantages of the invention and its preferred embodiments will become apparent from the detailed description and figures which follow.

DETAILED DESCRIPTION OF THE INVENTION

I. Definitions

Figure 1:
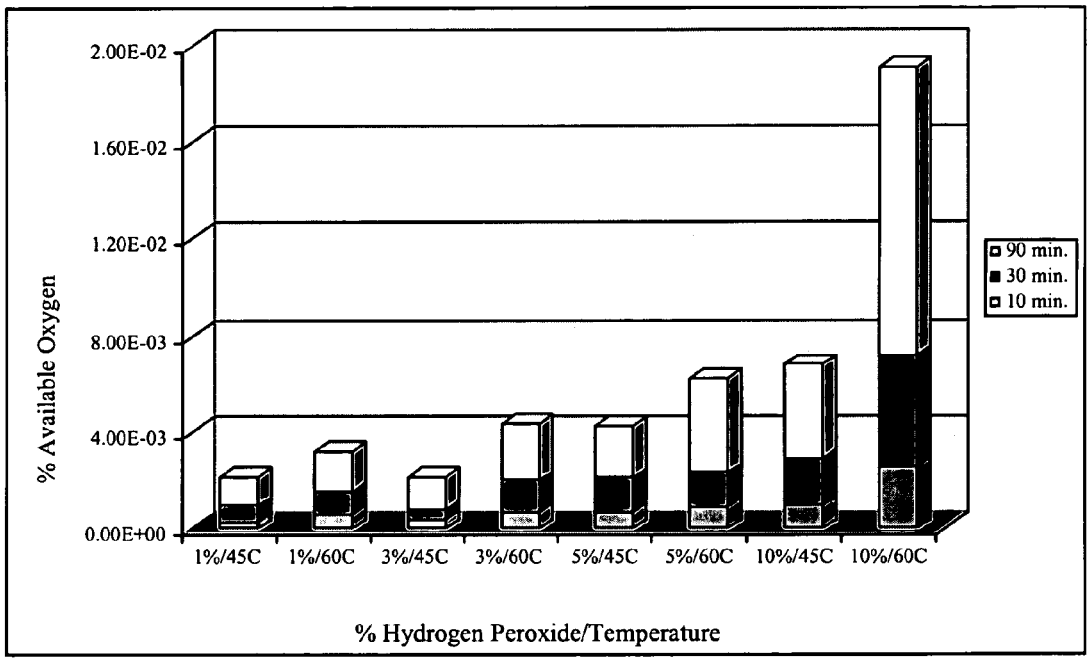
FIG. 1 illustrates the effects of bleaching conditions on the percentage available oxygen of 6% BTCA-treated cotton.

The terms "antimicrobial," "microbicidal," or "biocidal" as used herein, refer to the ability to kill at least some types of microorganisms, or to inhibit the growth or reproduction of at least some types of microorganisms. The fibers prepared in accordance with the present invention have microbicidal activity (antimicrobial) against a broad spectrum of pathogenic microorganisms. For example, the fibers have microbicidal activity against representative gram-positive (such as *Staphylococcus aureus*) and gram-negative bacteria (such as *Escherichia coli*). Moreover, the microbicidal activity of such fibers is readily regenerable.

"Polycarboxylic acid" as used herein, refers to an acid containing two or more carboxylic acid groups, all adjacent to each other along the back bone of the molecule. It includes salts and esters of carboxylic acids as well.

Polycarboxylic acids suitable for use in the present invention include 1,2,3,4----butanetetracarboxylic acid (BTCA), citric acid (CA) and polymaleic acid (PMA).

The polycarboxylic acids used in the present invention are commercially available from a number of different sources. For instance, BTCA is commercially available from Fisher Scientific, Pittsburgh, Pa. or VWR Scientific, South Plainfield, N.J.

"Peroxyacid," as used herein, refers to an acid derived from hydrogen peroxide by the replacement of one hydrogen atom: substitution by a R group in the case of an organic peroxyacid such as peracetic acid to form R—C(O)—O—OH. In fiber bleaching, similar to hydrogen peroxide, the reactivity of peroxyacid is located at the peroxidic (—O—O—) bond. By replacing one of the hydrogen atoms of hydrogen peroxide with an electron attracting substituent as R, it will lead to a dissymmetrical repartition of the electron charge $\delta^+$ and $\delta_-$ in the peroxidic bond. Peroxyacids can act as electrophilic reagents whereas this reactivity does not exist with hydrogen peroxide. On the other hand, peroxyacids can also act as nucleophilic reagents in the same manner as hydrogen peroxide.

As used herein "peroxycarboxylic acid functional group" refers to the product of a carboxylic acid such as a polycarboxylic acid, reacted with a peroxide moiety. A peroxycarboxylic acid functional group is one type of peroxyacid moiety. A peroxycarboxylic acid functional group is also derivable from a monocarboxylic acid group.

As used herein, "wetting agent" refers to a substance that increases the rate at which a liquid spreads across a surface, i.e., it renders a surface nonrepellent to a liquid. Examples of suitable wetting agents include, but are not limited to, Triton X-100 (Sigma Chemical Co., St. Louis, Mo.), SEQUAWET® (Sequal Chemical Inc., Chester, S.C.), and AMWET® (American Emulsions Co., Dalton, Ga.). Other wetting agents suitable for use in the present invention will be known to and used by those of skill in the art.

As used herein, "catalyst" refers to a substance which augments the rate of a chemical reaction without itself being consumed. Suitable catalysts for use in the present invention include, but are not limited to, the following: sulfuric acid, methanesulfonic acid, sulfonic acid and an ion-exchange resin.

II. Fibers

The present invention provides a fibrous composition, the composition comprising: a fiber; and a peroxycarboxylic acid functional group covalently attached to the fiber.

Fibers are among the most ubiquitous materials in society. The fibers suitable for the present invention include, but are not limited to, naturally occurring fibers from plants, such as cellulose, cotton, linen, hemp, jute and ramie. They include polymers from animals, based upon proteins and include, but are not limited to, wool, mohair, vicuna, chitin, chitosan and silk. Fibers also include manufactured fibers based upon natural organic polymers such as rayon, lyocell, acetate triacetate and azlon. Fibers suitable for use in the present invention include synthetic organic polymers which include, but are not limited to, acrylic, aramid, nylon, olefin, polyester, spandex, vinyon, vinyl and graphite. Fibers also include inorganic substances such as glass, metallic and ceramic.

The polymeric plastics suitable for the present invention include thermoplastic or thermosetting resins. The thermoplastics include, but are not limited to, polyethylene, polypropylene, polystyrene, and polyvinylchloride. Thermoplastics also include, polyamideimide, polyethersulfone, polyarylsulfone, polyetherimide, polyarylate, polysulfone, polycarbonate and polystyrene.

Additional polymers include, but are not limited to, celluphan, carboxymethyl cellulose, starch, polyetherketone, polyetheretherketone, polytetrafluoroethylene, nylon-6,6, nylon-6,12, nylon-11, nylon-12, acetal resin, polypropylene, and high and low density polyethylene.

Various fibers are preferred to practice the invention. These include, but are not limited to, a fiber, a yarn or a natural or synthetic fabric. Various fabrics include, but are not limited to, a nylon fabric, a polyester, an acrylic fabric, NOMEX®, a triacetate, an acetate, a cotton, a wool and mixtures thereof. NOMEX is made of an aromatic polyamide material and is available from DuPont (Wilmington, Del.).

Chitosan is a natural product derived from chitin, a polysaccharide found in the exoskeleton of shellfish such as shrimp or crabs. Chitosan has been effectively used to treat acne due to its ability to inhibit certain bacteria which cause the inflammation associated with acne. In addition, chitosan has exhibited the ability to kill *Candida* in clinical tests involving mice due to its effect on protease action. Chitosan can reduce the amount of bacterial translocation that can occur after a burn injury. Furthermore, chitosan also demonstrated that it has the ability to kill certain viruses. When used in the present invention, chitosan is effective as a wound healing agent. The biocidal chitosan can be used to treat wounds from burns, lacerations, cuts and bruises.

III. Peroxide and Peroxyacid

A popular alternative to replace or minimize the use of chlorine bleach are totally chlorine-free bleaching sequences known as TCF. One class of chemical bleaching agents commonly used in TCF is hydrogen peroxide and related peroxygen compounds. This class of bleaching agents is also referred to as oxidative bleaching agents or peroxygen bleaches. Oxidative bleaching agents eliminate the environmental concerns associated with chlorine bleaches and are unlimited for use on colored or non-colored fabrics.

Currently, hydrogen peroxide and related peroxy compounds are the most widely used class of bleaching agents in the United States. Since TCF systems were introduced, bleaching with hydrogen peroxide has become a well-established process (Mathews 1999). However, optimized bleaching is often not fully achieved nor understood due to difficulties in the processing and stabilization of the active oxygen species. Consequently, vast efforts have been made to improve the efficiency of TCF sequences by expanding the use of peroxy compounds such as peroxyacids.

Peroxyacids are frequently used as oxidizing agents because the perhydroxyl group in peroxyacids contains an electrophilic oxygen. In organic synthesis, these compounds can react, for example, with alkenes, by adding this oxygen to the double bond to form oxacycloproppropane through epoxidation; the other product of the reaction is a carboxylic acid.

The oxidative potential and related biocidal activity of peroxyacids is particularly desirable if imparted onto fibrous materials for use in antimicrobial applications. To develop an in situ finishing that offers such function on fibers, a primary finishing on the material similar to the function of N-methylol compounds is first incorporated. This allows for further modification of the incorporated structure into the desired peroxyacid form. One group of functionality for such primary finishing is a non-formaldehyde releasing durable press agents, polycarboxylic acids.

IV. Polycarboxylic Acids

Suitable polycarboxylic acids for the present invention include, but are not limited to, 1,2,3,4-butanetetracarboxylic acid (BTCA), citric acid (CA), maleic acid (MA) and polymaleic acid (PMA).

Scheme I

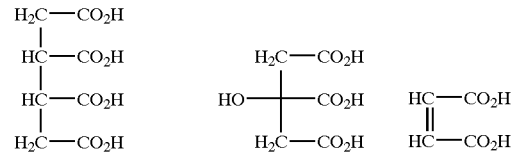

In certain aspects, the polycarboxylic acids contain two or more carboxylic acid groups, preferably adjacent to each other along the backbone of the molecule. In certain aspects, these acids react with cellulose hydroxyl groups to form ester-type crosslinks, connecting adjacent cellulose chains in a three-dimensional network inside, for example, cotton fibers. The crosslinking mechanism of polycarboxylic acids involves the formation of anhydride intermediates from adjacent carboxyls, resulting in the esterification with hydroxyls groups on, for example, cellulose.

In the case of BTCA, it has four carboxylic acid groups, which are adjacent to each other along the backbone of the molecule. In this aspect, the crosslinking mechanism involves the formation of a five-member cyclic anhydride intermediate from adjacent carboxyl groups. BTCA has the ability to form these anhydrides with several configurations, all of which result in at least two ester crosslinks with hydroxyl-containing molecules like, for example, cellulose. Without being bound by a particular theory, it is believed there are two possible configurations for the first reaction crosslink: the 1-position, which involves a terminal carboxyl group, whereas at the 2-position, it can react with one of the two internal carboxyl groups. It is believed that the product from the 1-position is able to form a second or even a third crosslink (Scheme 2).

In certain aspects, when BTCA forms a triplicate esterified-crosslink, there is at least one remaining carboxylic acid on the incorporated BTCA molecule. Due to its reactivity, the one or more remaining carboxyl group can undergo further modification to achieve other desired properties on the treated fibers (e.g., cotton).

Scheme 2

Formation of ester crosslinking in cellulose via BTCA.

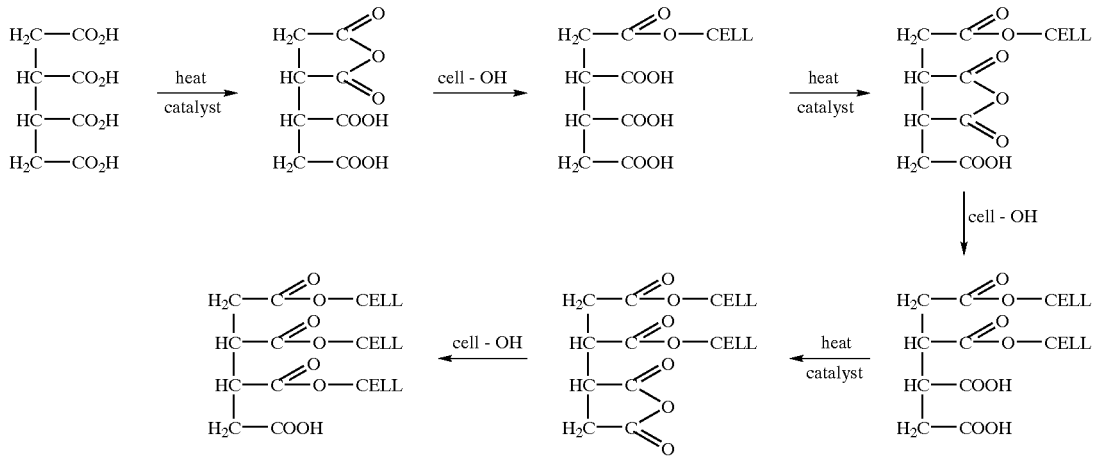

V. Formation of Peroxyacids (Peroxy Carboxylic Acids) on Cellulose and Subsequent Biocidal Properties Carboxylic acids are known to react with hydrogen peroxide ($H_2O_2$) in the presence of an acid to form peroxyacid (e.g. peroxycarboxylic acids) structures in the following manner (Swern 1970, Ogata 1971):

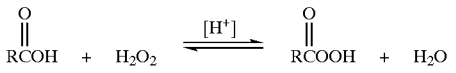

(1.6)

Similarly, when subjected to peroxide moieties, the unreacted or "free" acids on, for example, cellulose, can be converted into peroxyacid structures.

Scheme 3

The conversion of unreacted acids on cellulose into peroxyacid structure and the subsequent biocidal activity.

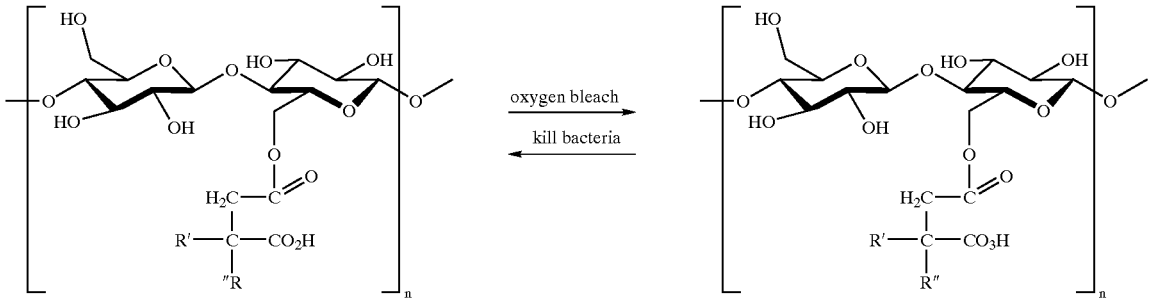

The present invention encompasses the incorporation of polycarboxylic acids onto fibers (e.g., cellulose), and its subsequent conversion into peroxyacid (e.g. peroxy carboxylic acids) structures via a peroxide moiety for use as an antimicrobial material, fiber or article. A common source of peroxide moieties for such conversion is oxygen bleach. Once impregnated with peroxyacid moieties, this material possesses oxidative potential that can inactivate, kill or reduce the number of microorganisms. Since covalently bonded polycarboxylic acid and fibers are not affected by such conversion nor laundering in water, the biocidal system can be regenerated (Scheme 3).

VI. Concentrations

Those of skill in the art will readily appreciate that the concentration of the various components of the aqueous treating solution can be widely varied depending upon the particular components employed and the results desired. Typically, the polycarboxylic acid in the aqueous treating solution is present at a concentration of at least about 0.2 to about 30%. More typically, the polycarboxylic acid is present at a concentration ranging from about 0.2% to about 20%, more preferably at a concentration ranging from about 0.5% to about 10% and, more preferably at a concentration ranging from about 4% to about 8%. It will be readily apparent to those of skill in the art that higher polycarboxylic acid concentrations (e.g., 50%) can be employed, but such higher concentrations are not required to impart microbiocidal activity. Again, suitable microbiocidal activity can be imparted using a polycarboxylic acid concentration as low as about 0.2%. The wetting agent is typically present at a concentration ranging from about 0.1% to about 3% and, more preferably, at a concentration ranging from about 0.2% to about 1%. The concentration of the catalyst employed will depend on the concentration of the polycarboxylic acid employed. Typically, the ratio of polycarboxylic acid to catalyst present will range from about 10:1 to about 5:1. The pH of the aqueous treating solution will typically range from a pH of about 2 to about 6 and, more preferably, from a pH of about 2.5 to about 4.5.

VII. Additives

Those of skill in the art will readily appreciate that other additives can be incorporated into the aqueous treating solution to impart favorable characteristics to the fiber (e.g., cellulosic, cellulosic/polyester or polyester fiber). Such additives can include, but are not limited to, softeners and waterproofing agents, which are known to and used by those of skill in the art. Examples of softeners which can be added to the aqueous treating solution include, but are not limited to, MYKON® and SEQUASOFT®, both of which are commercially available from Sequal Chemical Inc. (Chester, S.C.). Examples of waterproofing agents which can be added to the aqueous treating solution include, but are not limited to, SEQUAPEL® (Sequal Chemical Inc., Chester, S.C.), SCOTCHGARD (3M, St. Paul, Minn.) and other water repellent finishing solutions used by those of skill in the art.

VIII. Methods

The present invention also provides a process for preparing an antimicrobial fiber, the process comprising: (a) immersing a fiber in an aqueous treating solution comprising an organic acid; and (b) treating the fiber with an oxidizing agent to produce a percarboxylic acid function, thereby preparing an antimicrobial fiber. In a preferred embodiment, the organic acid has at least two carboxylic acid functionalities.

In carrying out step (a), the fiber used can be, for example, roving, yarn or fabric regardless of whether spun, knit, or woven, or may be nonwoven sheets or webs. Moreover, the fiber can be made of cellulosic fibers, polyester fibers or blends of these. In addition, other polymer materials having reactive functional groups (e.g., —OH groups) can be used. Such polymer materials include, but are not limited to, polyvinyl alcohol (PVA), chitin, chitosan, starches and proteins. In wetting the fiber in the finishing or treating bath, ordinary fiber equipment and methods suitable for batchwise or continuous passage of roving, yarns or fabrics through an aqueous solution may be used, at any speed permitting thorough and uniform wetting of the fiber.

The excess aqueous treating solution is removed by ordinary mechanical methods such as by passing the fiber between squeeze rolls, by centrifugation, by draining or by padding. In a preferred embodiment, the excess aqueous treating solution is removed by padding.

The fiber (e.g., cellulosic, cellulosic/polyester or polyester fiber) is dried at a temperature ranging from about 50° C. to about 90° C. and, more preferably, at a temperature ranging from about 75° C. to about 85° C. for a period of time ranging from about 3 to about 8 minutes and, more preferably, for about 5 minutes.

After drying, the dried fiber (e.g., cellulosic, cellulosic/polyester or polyester fiber) is cured at a temperature ranging from about 120° C. to about 180° C. and, more preferably, at a temperature ranging from about 160° C. to about 180° C. for a period of time ranging from about 0.5 to about 5 minutes and, more preferably, for about 1.5 minutes. The heating can be carried out in an oven, preferably one having a forced draft of air directed at the surface of the fiber and exhausting through a vent to remove fumes.

After curing, the dried fiber (e.g., cellulosic, cellulosic/polyester or polyester fiber) is washed. Machine washing of the treated fiber is done at a temperature ranging from about 40° C. to about 60° C. and, more preferably, at a temperature about 50° C. for a period of time ranging from about 10 to about 40 minutes and, more preferably, for about 30 minutes. The covalent bonds formed are stable, insoluble, and durable to the mechanical agitation, spraying and rubbing that occurs in washing machines or in large scale continuous or batchwise fiber washing equipment.

Final drying can be carried out by air-drying at constant temperature and humidity. A drying temperature of about 21° C. at about 65% relative humidity for about at least 24 hours is particularly preferred.

In yet another embodiment, the present invention provides a composition for finishing a fiber, the composition comprising a wetting agent; and a polycarboxylic acid. In a preferred embodiment, the composition further includes a catalyst. In an even more preferred embodiment, the composition further includes additives (e.g., softeners and waterproofing agents) to impart favorable characteristics. The discussions pertaining to the polycarboxylic acids, wetting agents, catalysts, additives and their various concentrations are fully applicable to this composition and, thus, such discussions will not be repeated again. The pH of the aqueous treating solution will typically range from a pH of about 2 to about 6 and, more preferably, from a pH of about 2.5 to about 4.5. Those of skill in the art will readily appreciate that the above composition can be prepared in a concentrated form or, alternatively, in a form suitable for immediate use, i.e., at appropriate reagent concentrations.

Considering both antibacterial and mechanical properties of the finished fiber prepared using the methods and compositions set forth herein, those of skill will readily appreciate that such a finished fiber, textile and the like can advantageously be used in the preparation of the following articles: surgeon's gowns, caps, masks, surgical cover, patient drapes, carpeting, bedding materials, underwear, socks, uniforms, bandages, wound agents, burn bandages, etc. Those of skill in the art will readily appreciate that the finished fibers of the present invention can also advantageously be used for a variety of other purposes, such as in hotel-use towels, bedding materials, hygienic products, in various clothing to protect against pesticides and other toxic chemicals, etc.

IX. Applications

There are various applications for the microbicidal fibers of the present invention. For instance, the microbicidal fibers can provide biocidal protective clothing to personnel in the medical area as well as in the related healthcare and hygiene area. The regenerable and reusable biocidal materials can replace currently used disposable, nonwoven fabrics as medical fibers, thereby significantly reducing hospital maintenance costs and disposal fees. The microbicidal properties of the fibers of the present invention can be advantageously used for women's wear, underwear, socks, and other hygienic purposes. In addition, the microbicidal properties can be imparted to carpeting materials to create odor-free and germ-free carpets. Furthermore, the microbicidal fibers of the present invention are useful as a first line defense against biological warfare. Moreover, all germ-free environments, such as required in biotechnology and pharmaceutical industry, would benefit from the use of the microbicidal fibers of the present invention to prevent any contamination from air, liquid, and solid media.

The invention will be described in greater detail by way of specific examples. The following examples are offered for illustrative purposes, and are intended neither to limit or define the invention in any manner.

X. EXAMPLES

Example 1

Formation of Peroxide Moieties on Cellulose Under Acidic Condition: Hydrogen Peroxide as a Bleaching Agent This Example illustrates the amount of peroxyacid moieties (a peroxy carboxylic acid functional group) on a modified fiber via chemical titration as well as observation of biocidal activities.

1. Materials

Cotton fabrics were selected in this study. These fabrics were bleached, desized cotton print cloth (#400) purchased from Testfabrics, Inc., West Pittston, Pa. 1,2,3,4-butanetetracarboxylic acid (BTCA), hydrogen peroxide (30%), sulfuric acid and all other reagents were purchased from Fisher Scientific, Pittsburgh, Pa. or VWR Scientific, South Plainfield, N.J.

2. Methods

Cotton fabrics were treated in a regular wet finishing process, i.e. pad-dry-cure method, with a two-dip-two-nip process with a concentration of 6% BTCA. Wet pick-up average to 118%. The treated fabrics were dried at 80° C. for 5 min. and cured at 175° C. for 1.5 min. After which, the fabrics were machine-washed at 50° C. for 30 min. The fabrics were then air-dried at constant temperature and humidity (21° C., 65% relative humidity) for at least 24 hours. These finished fabrics were then treated with hydrogen peroxide in various concentrations at various temperatures and treatment duration using a 50:1 liquor ratio. The pH of all treatment baths was adjusted to pH 3–4 using 1.5N sulfuric acid solution. The treated fabrics were thoroughly rinsed and then, air-dried and stored at standard condition prior to further testing, analysis and characterization.

Structures of the modified fabrics were analyzed with an infrared spectrophotometer (Nicolet Magna IR-560). All of the spectra were generated by an absorbance method from sample pellets containing potassium bromide as a reference.

Samples of 0.0030 g in weight were mixed with 0.200 g of KBr. Each spectrum was based on 120 scans with a resolution of 4.0 $cm^{-1}$.

Quantitative analysis of the percentage available oxygen on the modified cellulose was carried out by way of chemical titration of these modified fabrics, following the American Association of Fiber Chemists and Colorists (AATCC) standard test method 172, section 12–18 (AATCC 1997). Three-gram treated and untreated samples were used in such titration. Prior to titration, all samples were ground into fine powder form in a small laboratory mill (Arthur Thomas Scientific, Philadelphia, Pa.). Each finely ground sample was acidified by using a mixture of 100 mL 1.5N sulfuric acid, and then, mixed with 15 mL potassium iodide solution and 10 mL dichloromethane in the dark for 15 min. This mixture was then titrated without any incident light using 0.005N sodium thiosulfate; 5% starch solution was used as an indicator. Under acidic condition during such chemical titration, oxygen species such as peroxyacids are capable of oxidizing iodide ion from the potassium iodide solution to free iodine which is indicated by a change in color in starch solution. The amount of oxidized iodide ion is titrated by using sodium thiosulfate solution. The percentage available oxygen of each sample was calculated using equation (3.3) according to the standard method. All titration analyses were carried out with at least three repetitive samples at any condition.

$$\%\ \text{Available Oxygen} = \frac{\text{mL } Na_2S_2O_3 \times \text{normality of } Na_2S_2O_3 \times 0.8}{\text{weight of sample in } g} \quad (3.3)$$

Biocidal properties of the modified fabrics were quantitatively evaluated against the microorganism, *Escherichia coli* (American Type Cell Culture #15597) according to the AATCC standard test method 100. All tests were carried out using at least three repetitive samples at any condition.

3. Results

Chemical Finishing of Fabrics

The average percentage wet pick-up and add-on for this 6% BTCA (w/v) finishing were 118% and 5.9% respectively.

Quantitative Analysis of the Peroxyacid Structure

The chemical conversion of free acids into peroxyacids (peroxycarboxylic acid functional groups) on BTCA-treated cellulose was carried out by the introduction of oxygen species from hydrogen peroxide. Since neither cellulose nor the treated BTCA itself possesses any active oxygen species, only the fabrics that were successfully converted to peroxyacid structures would be capable of oxidizing iodide ion (from the potassium iodide solution) to free iodine under acidic condition in this titration method. Free iodine is identified by the appearance of a deep purplish-blue color in the presence of starch solution. This means that only samples containing peroxyacid structures would turn purplish-blue after starch solution is added.

In this analysis, all BTCA-treated samples that were modified with hydrogen peroxide showed a purplish-blue color in varying intensities. In order to confirm this observation, BTCA-treated, but not bleached, cotton as well as untreated cotton fabrics, were also tested as control samples. The results showed that both types of control samples did not yield any color change during such titration.

The concentration of hydrogen peroxide relates to the percentage available oxygen on the modified fabrics (FIG. 1). As the concentration of hydrogen peroxide was increased, the titrated percentage available oxygen also increased at both temperatures. This increase is particularly pronounced with samples treated at 60° C. Samples that were treated with the highest concentration of hydrogen peroxide (10%) showed the highest percentage available oxygen at both temperatures and at all treatment times.

The dissociation of hydrogen peroxide has been widely described. One resultant of this dissociation is perhydroxyl anion, which is directly related to effective bleaching. The formation or concentration of perhydroxyl anion during such dissociation is found to increase with rising temperature of the solution.

When the BTCA-treated cellulose was modified by hydrogen peroxide, increased concentration of hydrogen peroxide in the treatment solution yields an increase in the concentration of perhydroxyl moiety formed, which then reacts with the free acids on the treated cellulose to form peroxyacid moieties. Since these peroxyacid moieties contain at least one active oxygen, increased concentration of perhydroxyl moiety resulted in the increased formation of peroxyacid moieties on cellulose which then, increased the oxidative potential, reflected by the increased percentage available oxygen from the chemical titration.

Similarly, since the formation of perhydroxyl moiety is dependent on rising temperature, the increase in treatment temperature of sodium perborate on BTCA-treated cellulose leads to an increase in peroxyacid formation, which eventually causes the increase in percentage available oxygen on the modified fabrics. It is evident that samples treated at higher treatment temperature invariably yielded improved oxidative potential at all concentration levels (FIG. 1).

Since hydrogen peroxide decomposes above 65° C., its dissociation in the formation of perhydroxyl moiety would be very rapid near this temperature. Consequently, at the treatment temperature of 60° C., the percentage available oxygen has shown to be superior to the other samples treated at lower temperatures because the formation of perhydroxyl moiety occurred rapidly, leading to the subsequent rapid conversion of peroxyacid moieties on cellulose.

The effect of treatment duration of hydrogen peroxide on BTCA-treated cellulose was also examined. Since the formation of peroxyacid moieties on cellulose is related to the reaction of hydrogen peroxide and the free acids on cellulose, the duration in which the two were allowed to react could affect the formation of peroxyacids. Results show that extended treatment time improved the percentage available oxygen at all concentrations (FIG. 1). The difference is most remarkable for samples treated with 10% hydrogen peroxide for 90 min. at 60° C. The conversion of the free acids into peroxyacids is likely to be kinetically driven as the extension of reaction time resulted in relatively higher percentage available oxygen.

Although treatment time appears to affect the formation of peroxyacid moieties on cellulose and the subsequent relative oxidative potential, treatment concentration has shown to be a more dominant factor. However, as the treatment concentration was increased to 10%, the percentage available oxygen increased drastically, especially for those samples treated at 60° C. (FIG. 1).

Scheme 4 depicts one mechanism for the acid catalyzed reaction of hydrogen peroxide on the BTCA-treated cellulose. First, one of the esters of the BTCA linker is protonated under acidic conditions which leads to the nucleophilic attack of hydrogen peroxide. This addition converts the carbonyl carbon from a triagonal planar structure to a tetrahedral intermediate ($SP^2$ to $Sp^3$ hybridization). In order to drive the equilibrium forward, a hydrogen transfer takes place. This step sets the stage for peroxyacid formation. The addition of a pair of electrons followed by the elimination of water regenerates the carbonyl carbon. Finally, neutralization of the crosslinking agent leads to the peroxyacid functionality.

Scheme 4

Formation of peroxyacid on BTCA-treated cellulose under acidic condition.

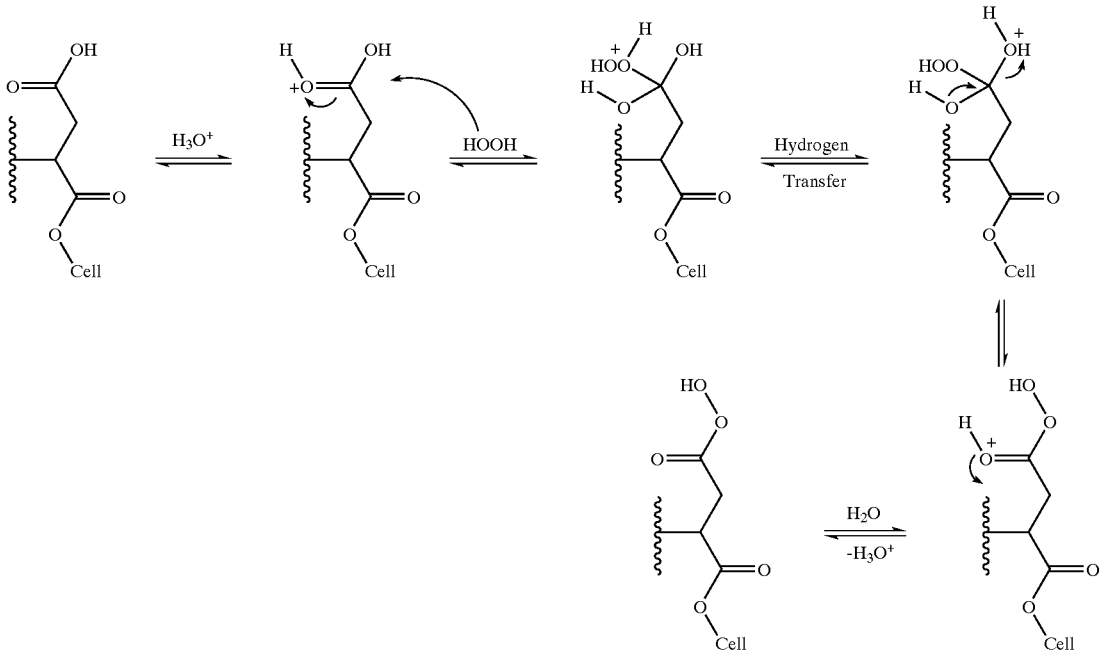

Since BTCA has four carboxylic acids in its structure and its crosslinking with cellulose always leave at least one or more free acids, in certain aspects of the formation of peroxyacid is dependent on the amount of perhydroxyl moiety available in the treatment solution. Hence, hydrogen peroxide concentration plays a dominant role in the oxidative potential analysis of the treated fabrics. Also, this reaction appears to be kinetically driven as the extension of treatment time allows for enhanced oxidative potential.

Biocidal properties of BTCA-Treated Cellulose Modified with Hydrogen Peroxide

From the results of the chemical titration analysis, the BTCA-treated cellulose treated with hydrogen peroxide exhibited some levels of oxidative properties. Therefore, this modified cellulose will demonstrate a certain level of biocidal property. The biocidal properties of these fabrics against microorganisms were therefore examined under various treatment conditions.

Figure 2:
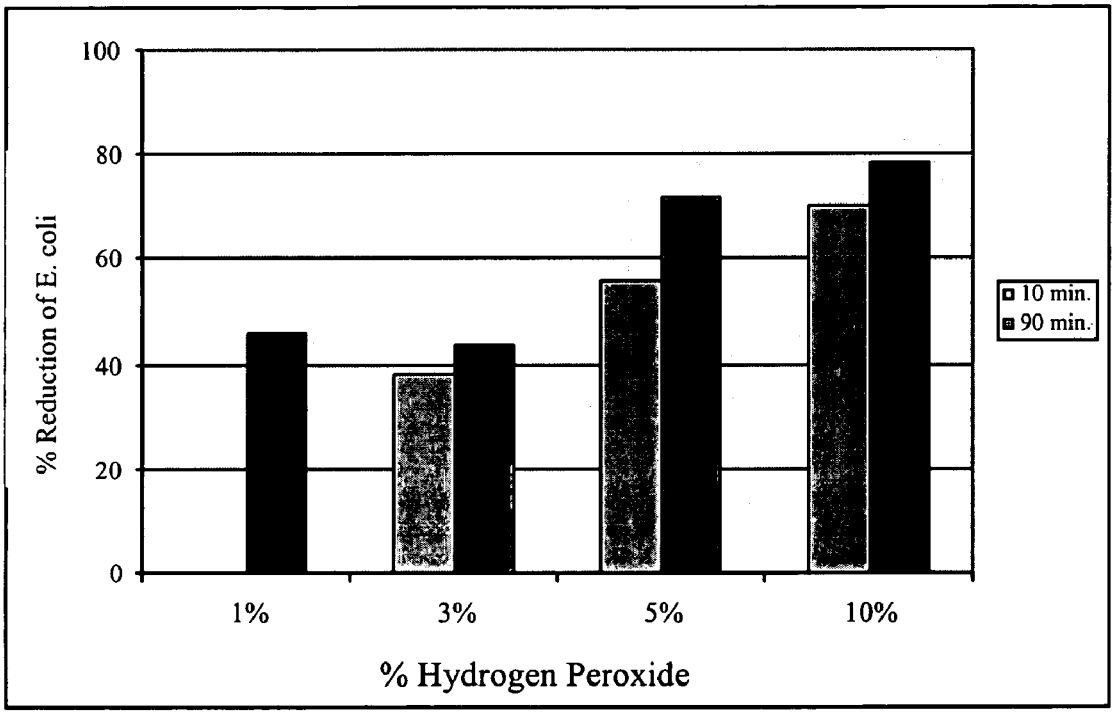
FIG. 2 illustrates the biocidal efficacy of 6% BTCA cotton treated with various hydrogen peroxide concentrations at 60° C.

Similar to the observation made from the chemical titration analysis, the percentage reduction of *Escherichia coli* increased as the treatment concentration was increased (FIG. 2). This is particularly evident as the samples treated with the highest hydrogen peroxide concentration yielded the most biocidal efficacy even at a shorter treatment time (10 min.). Samples that were treated with 5% hydrogen peroxide for a prolonged 90 min. offered comparative biocidal efficacy to those treated with 10% hydrogen peroxide for 10 min. Hydrogen peroxide concentration remains a dominant factor in attaining biocidal properties on these modified fabrics.

FT-IR Analysis

Figure 3:
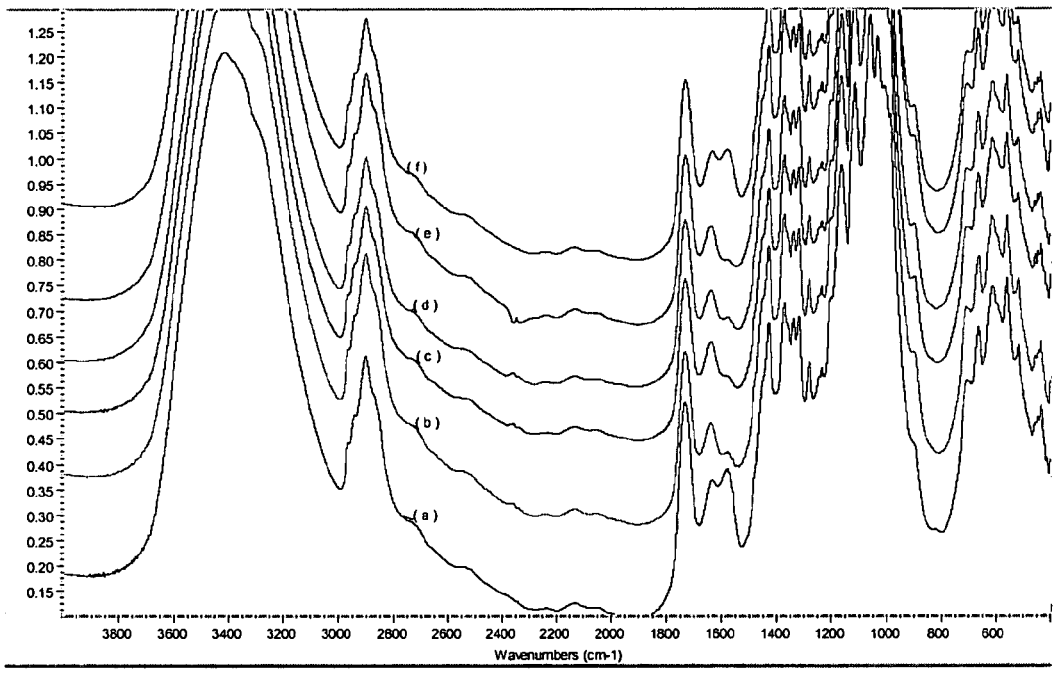
FIG. 3 illustrates the FT-IR spectra of cotton treated with 6% BTCA and (a) not bleached; (b) 3% hydrogen peroxide at 45° C., 10 min.; (c) 3% hydrogen peroxide at 45° C., 30 min.; (d) 3% hydrogen peroxide at 60° C., 10 min.; (e) 3% hydrogen peroxide at 60° C., 30 min.; and (f) 5% hydrogen peroxide at 45° C., 30 min.

The FT-IR analysis of 6% BTCA-treated cellulose treated with hydrogen peroxide showed that as the concentration was increased from 1% to 10%, the intensities of the respective ester bands at 1727 $cm^{-1}$ remained unchanged (FIG. 3). This indicates that the ester crosslinkages in between BTCA and cellulose were not damaged by the additional bleaching procedure, neither were they affected by bleaching conditions such as concentration, temperature and treatment time. This further substantiates that the reaction is reversible and regenerable.

Correlation Between Available Oxygen and Biocidal Properties

Figure 4:
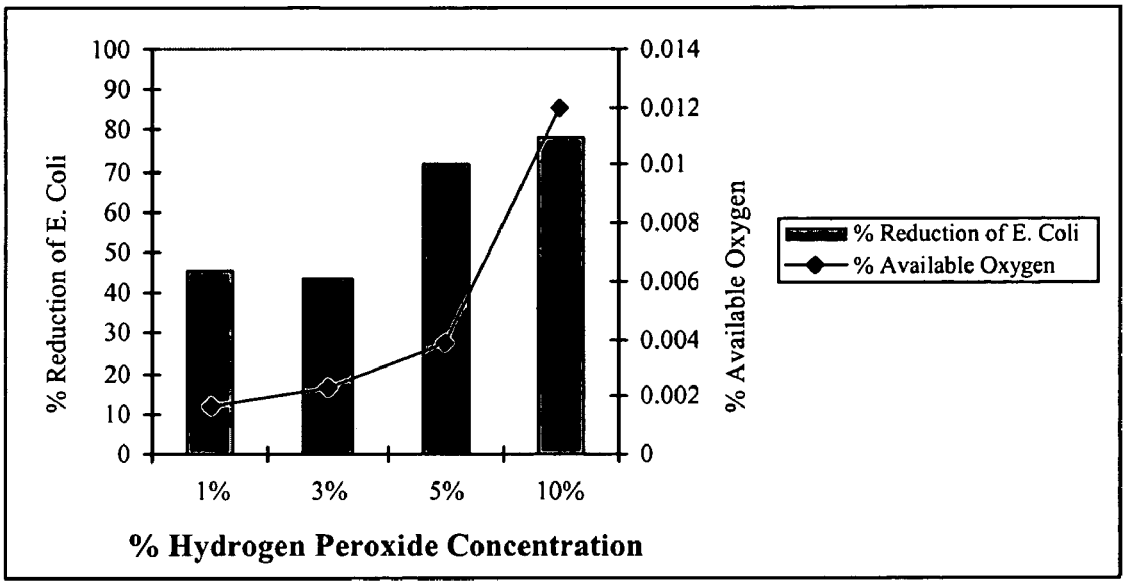
FIG. 4 illustrates the percentage available oxygen and relative biocidal efficacy of 6% BTCA cotton at 60° C., 90 min.

The biocidal properties of the modified cellulose are closely related to the amount of active oxygen on the fabric. As shown in FIG. 4, in order to attain over 70% reduction of *Escherichia coli*, the percentage available oxygen on the modified fabrics needed to be at least 0.004% (5% hydrogen peroxide). Chemical titration is indicative in determining the level of oxidative potential and formation of peroxyacid moieites on cellulose.

Example 2

Figure 5:
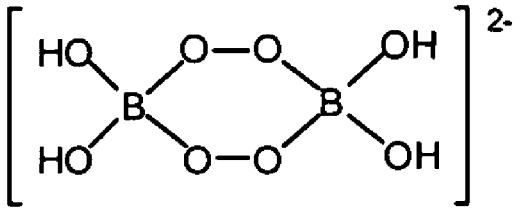
FIG. 5 illustrates the formula of perborate.

Formation of Peroxide Moieties on Cellulose under Basic Condition: Sodium Perborate as a Bleaching Agent 1. Materials Cotton fabrics were selected in this study. These fabrics were bleached, desized cotton print cloth (#400) purchased from Testfabrics, Inc., West Pittston, Pa. 1,2,3,4-butanetetracarboxylic acid (BTCA), sodium perborate tetrahydrate, $NaBO_3.4H_2O$ (FIG. 5) and sodium silicate (SS, 27%) were purchased from Aldrich Chemical Company, Milwaukee, Wis. All other reagents were purchased from Fisher Scientific, Pittsburgh, Pa. or VWR Scientific, South Plainfield, N.J.

2. Methods

Cotton fabrics were treated in a regular wet finishing process, i.e. pad-dry-cure method, with a two-dip-two-nip process at a concentration of 6% BTCA. Wet pick-up average to 125%. The treated fabrics were dried at 80° C. for 5 min. and cured at 175° C. for 1.5 min. After which, the fabrics were machine-washed at 50° C. for 30 min. The fabrics were then air-dried at the standard condition of 21° C., 65% relative humidity for at least 24 hours. These finished fabrics were then treated with sodium perborate in various concentrations, temperatures and treatment duration using a 50:1 liquor ratio at pH 10–11. A common oxygen bleach stabilizer, sodium silicate was also used. These treated fabrics were rinsed in distilled water several times and then, air-dried and stored at standard condition prior to further testing, analysis and characterization.

Structures of the modified fabrics were analyzed by using a FT-IR spectrophotometer (Nicolet Magna IR-560). All of the spectra were generated by an absorbance mode from sample pellets containing potassium bromide as a reference. Samples of 0.0030 g in weight were mixed with 0.200 g of KBr. Each spectrum was based on 120 scans with a resolution of 4.0 $cm^{-1}$.

Quantitative analysis of the percentage available oxygen on the modified cellulose was carried out by way of chemical titration of these modified fabrics, following the American Association of Fiber Chemists and Colorists (AATCC) standard test method 172, section 12–18 (AATCC 1997). Three-gram treated and untreated samples were used in such titration. Prior to titration, all samples were ground into fine powder form in a small laboratory mill (Arthur Thomas Scientific, Philadelphia, Pa.). Each finely ground sample was acidified by using a mixture of 100 mL 1.5N sulfuric acid, 15 mL potassium iodide solution and 10 mL dichloromethane in the dark for 15 min. This mixture was then titrated in the dark, using 0.005N sodium thiosulfate with 5% starch solution as an indicator. The percentage available oxygen of each sample was calculated from equation (3.3) according to the standard method. All titration analysis was carried out using at least three repetitive samples at any condition.

Repeated laundering tests were also carried out in a Launder-O-Meter® (Atlas Electric Devices, Co., Chicago, Ill.) at room temperature by following AATCC standard test method 124.

3. Results

Chemical Finishing of Fabrics

The average percentage wet pick-up and add-on for this 6% BTCA (w/v) finishing were 125% and 5.9% respectively.

Quantitative Analysis of the Peroxyacid Structure

Figure 6:
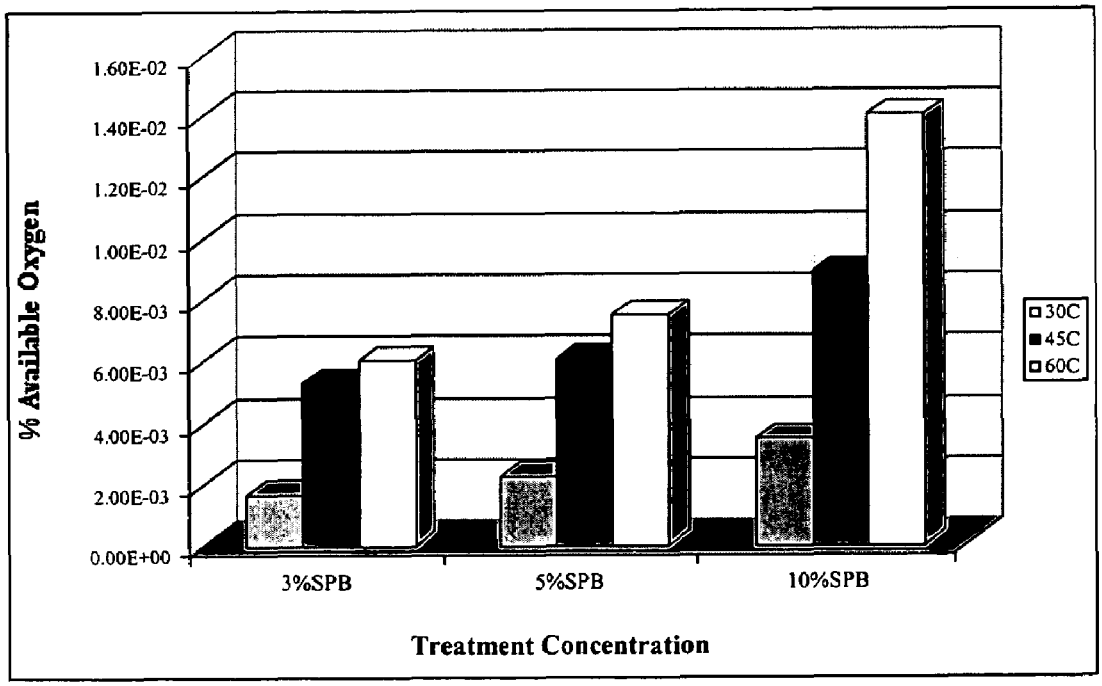
FIG. 6 illustrates the effect of treatment condition on the percentage available oxygen of 6% BTCA cotton modified with SPB.

Sodium perborate concentration was found to be related to the percentage available oxygen on the modified fabrics (FIG. 6). As the concentration of sodium perborate was increased, the titrated percentage available oxygen also increased.

Increased concentration of sodium perborate in the treatment solution increases the amount of perhydroxyl anions formed, which then increases the formation of peroxyacid moieties. Thus, increased concentration of perhydroxyl anions resulted in the increased formation of peroxyacid moieties, which increased the oxidative potential. This is indicated by the increase in percentage available oxygen from the chemical titration.

As mentioned before, sodium perborate liberates hydrogen peroxide in aqueous solution. The dissociation of hydrogen peroxide has been widely described according to equation (4.2):

$$H_2O_2 \rightleftharpoons H^+ + OOH^- \tag{4.2}$$

One resultant of this dissociation is perhydroxyl anion, which is believed to be directly related to effective bleaching. The formation or concentration of perhydroxyl anion during such dissociation is found to increase with rising temperature as well as pH of the solution. Although the formation of oxidative species or peroxyacids on the treated cellulose seemingly occurred as previously discussed, via the reaction of perhydroxyl anions and free acids, this formation is unlikely to have proceeded in such a fashion due to the change in pH of the treatment bath. Under alkaline condition, the BTCA-esterified cellulose could undergo hydrolysis (Scheme 5).

Scheme 5

Hydrolysis of ester.

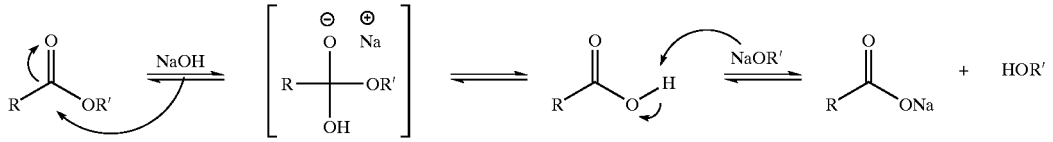

Biocidal properties of the modified fabrics were quantitatively evaluated against the microorganism, *Escherichia coli* (American Type Cell Culture #15597) according to AATCC standard test method 100. All tests were carried out using at least three repetitive samples at any condition.

Similarly, the perhydroxyl anion from the sodium perborate solution can act as a nucleophile, attacking the ester bond in between BTCA and cellulose, making cellulose as a good leaving group, thus, forming peroxyacid acid yet cleaving off one crosslink (Scheme 6).

Scheme 6

Formation of peroxyacid and subsequent hydrolysis of the esterified cellulose.

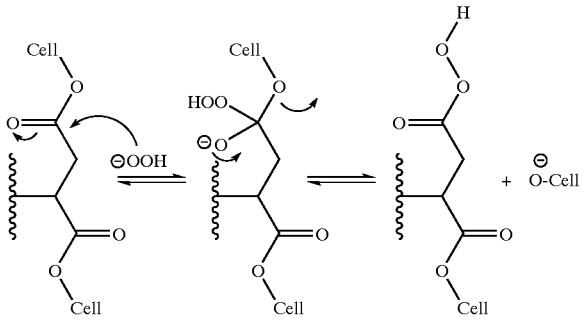

This mechanism is also in agreement with the perhydrolysis reaction of bleach activators such as tetraacetylethylenediamine (TAED) and sodium nonanoyloxybenzenesulphonate (NOBS) in the generation of peroxyacid during bleaching. The rate of such perhydrolysis was found to be directly related to the leaving group. More facile leaving groups have shown to increase the rate of perhydrolysis (Grime 1990).

Due to the fact that polycarboxylic acids contain more than one carboxyl group, they have a tendency to form multiple crosslinkages; often, resulting in a network of crosslinking. In the case of BTCA, due to the fact that it contains four carboxylic groups, efficient triplicate crosslinking with cellulose, i.e. the formation of three ester linkages can be attained (Schramm 2000). The possibilities of BTCA multiple crosslinking in forming two and three esters on cellulose are 83% and 17% respectively (Shank 2002). Consequently, after the BTCA-treated cotton is modified with sodium perborate, the subsequent ester hydrolysis would cleave off one crosslinkage, leaving at least one or two other crosslinkages with cellulose.

Since the formation of perhydroxyl anions is dependent on rising temperature, the increase in treatment temperature of sodium perborate on BTCA-treated cellulose contributes to the increase in peroxyacid formation, which will lead to higher percentage available oxygen on the modified fabrics.

Three treatment temperatures were used to mimic the three temperature selections in domestic washing machines: cold wash (30° C.), warm wash (45° C.) and hot wash (60° C.). At all three SPB concentrations, the percentage available oxygen increased as the treatment temperature was raised from 30° C. to 60° C. (FIG. 6). This increase is particularly substantial at the 10% SPB level. At all three concentrations, the increase in percentage oxygen is most pronounced as the temperature was increased from 30° C.

Since hydrogen peroxide decomposes above 65° C., its dissociation in the formation of perhydroxyl anions would be very rapid near this temperature. Consequently, at the treatment temperature of 60° C., the percentage available oxygen has shown to be superior to the other samples treated at lower temperatures because the formation of perhydroxyl anions occurred rapidly, leading to the subsequent rapid formation of peroxyacid moieties. Another study also reported that temperature had marked effects on the final brightness of the bleached product and also on the rate of sodium perborate consumption. An increase in temperature from 40° C. to 70° C. allowed for the reduction of bleaching time to obtain predetermined pulp brightness in bleaching; this was largely attributed to the increase in peroxide decomposition. The decomposition of peroxide was considered to have a first-order reaction rate in which the rate constant was strongly dependent on temperature. The calculated activation energy for sodium perborate was 44.4 kJ/mol (Varennes 1996).

In practice, fiber bleaching using sodium perborate is performed at high temperatures under alkaline conditions based on the fact of the rapid perhydroxyl anion formation for effective bleaching under such conditions (Week 1989). This is usually conducted in the presence of sodium silicate. Sodium perborate liberates hydrogen peroxide in aqueous solution. At high temperature, the decomposition of hydrogen peroxide has been reported to accelerate. However, the use of sodium silicate helped to stabilize the hydrogen peroxide through the formation for peroxysilicates, reducing the rate of decomposition.

Figure 7:
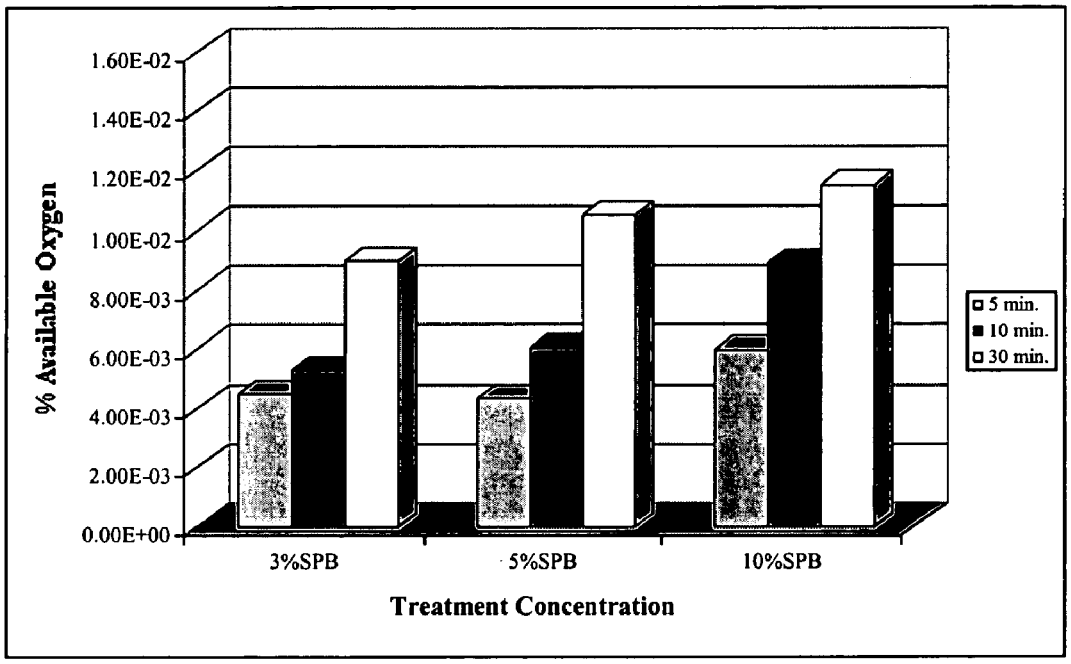
FIG. 7 illustrates the effect of treatment time on the percentage available oxygen of 6% BTCA cotton modified with SPB at 45° C.

The effect of sodium perborate treatment time on BTCA-treated cellulose was also examined. Since peroxyacid moieties are formed via the perhydroxyl anions, the duration in which the specie is allowed to react could affect the formation of peroxyacids. At 45° C., samples that were treated at prolonged duration of 10 min. and 30 min. showed higher percentage available oxygen at all three concentration levels (FIG. 7).

Figure 8:
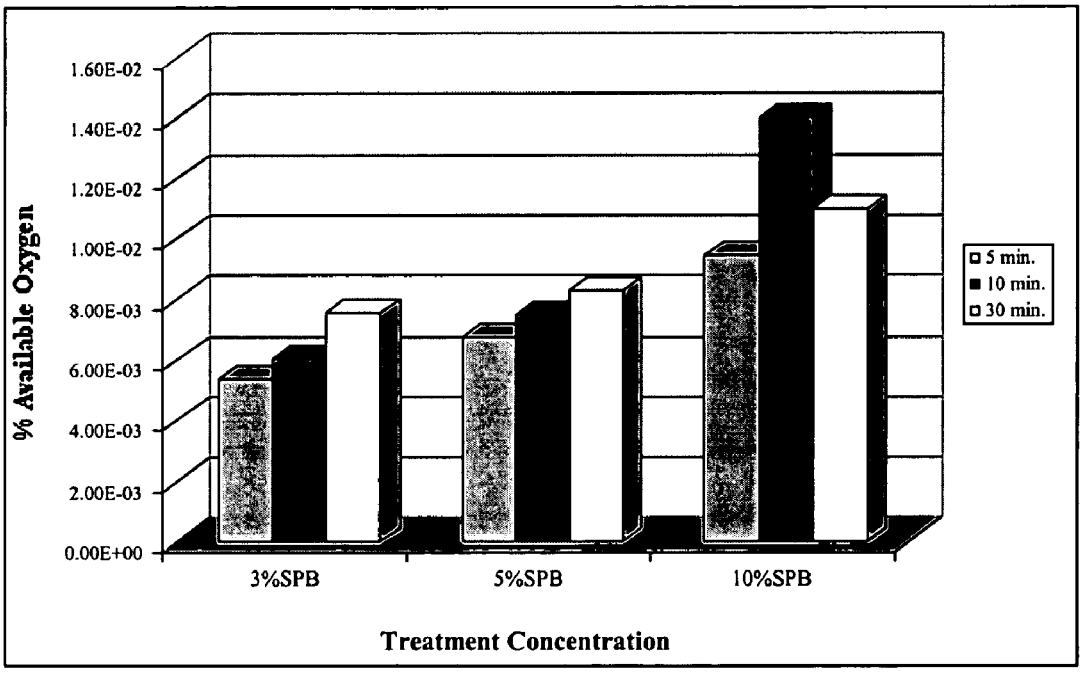
FIG. 8 illustrates the effect of treatment time on the percentage available oxygen of 6% BTCA cotton modified with SPB at 60° C.

Furthermore, similar trend is observed at 60° C. (FIG. 8). Extended treatment time improved the percentage available oxygen at all concentrations. This suggests that the formation of peroxyacids is likely to be thermodynamically driven as the increase in temperature even at lower treatment concentration resulted in relatively higher percentage available oxygen.

Analogous to previous observations made from treatment concentrations and temperature, extended treatment time at a high SPB concentration (10%) and higher temperature (60° C.), resulted in an increase in the percentage available oxygen. The potential amount of available perhydroxyl anions rapidly increased as the amount of sodium perborate was raised to 10% at an optimum temperature, resulting in an increase in peroxyacid formation.

Figure 9:
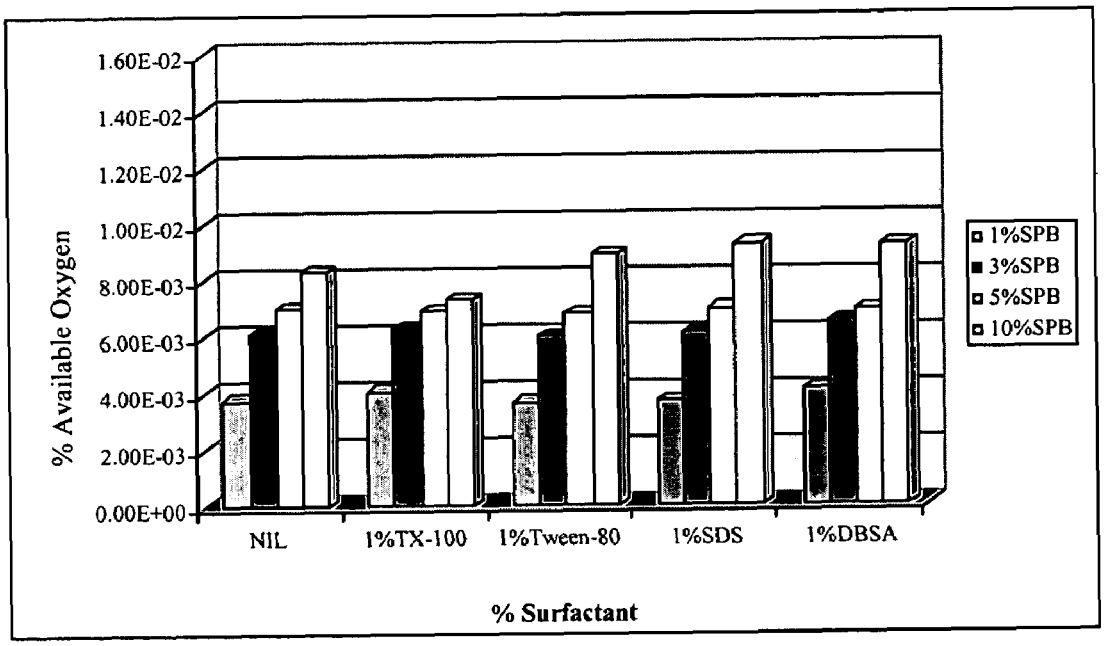
FIG. 9 illustrates the effect of various surfactants on the percentage available oxygen of 6% BTCA cotton modified with SPB at 60° C., 10 min.

In addition to treatment concentration, temperature and time, the effect of surfactants was also studied. Two different types of surfactants or wetting agents were used. Triton X-100® and Tween 80® were used as non-ionic surfactants, dodecyl sodium sulfate (SDS) and dibenzoic sulfonic acid (DBSA) were used as anionic surfactants. Overall, the use of surfactants did not show a substantial increase in the percentage available oxygen on the modified cellulose (FIG. 9). Wetting agents or surfactants are usually added to reduce surface tension so as to enhance the effects of bleaching (Perkins 1996). In this case, the surfactants did not dramatically affect the percentage available oxygen. This could be due to the fact that under alkaline condition, cellulose could undergo slight swelling, similar to the effect of mercerization. The incorporated BTCA on cellulose became accessible to the perhydroxyl anions resulting from the decomposition of sodium perborate.

At the various sodium perborate concentrations, samples that were treated at the highest concentration of 10% SPB showed the highest percentage available oxygen for Tween-80®, SDS and DBSA. This is in agreement with the observation made earlier with the effect of treatment concentration. The increased amount of sodium perborate in the treatment solution provided additional amount of perhydroxyl anions, enhancing peroxyacid formation, and again, resulting in the increase in percentage available oxygen on BTCA-treated cellulose.

Biocidal Properties of BTCA-Treated Cellulose Modified with Sodium Perborate

From the chemical titration analysis, the BTCA-treated cellulose modified with sodium perborate exhibited oxidative properties. The biocidal properties of these fabrics against the microorganism *Escherichia coli* were therefore examined under various treatment conditions.

Figure 10:
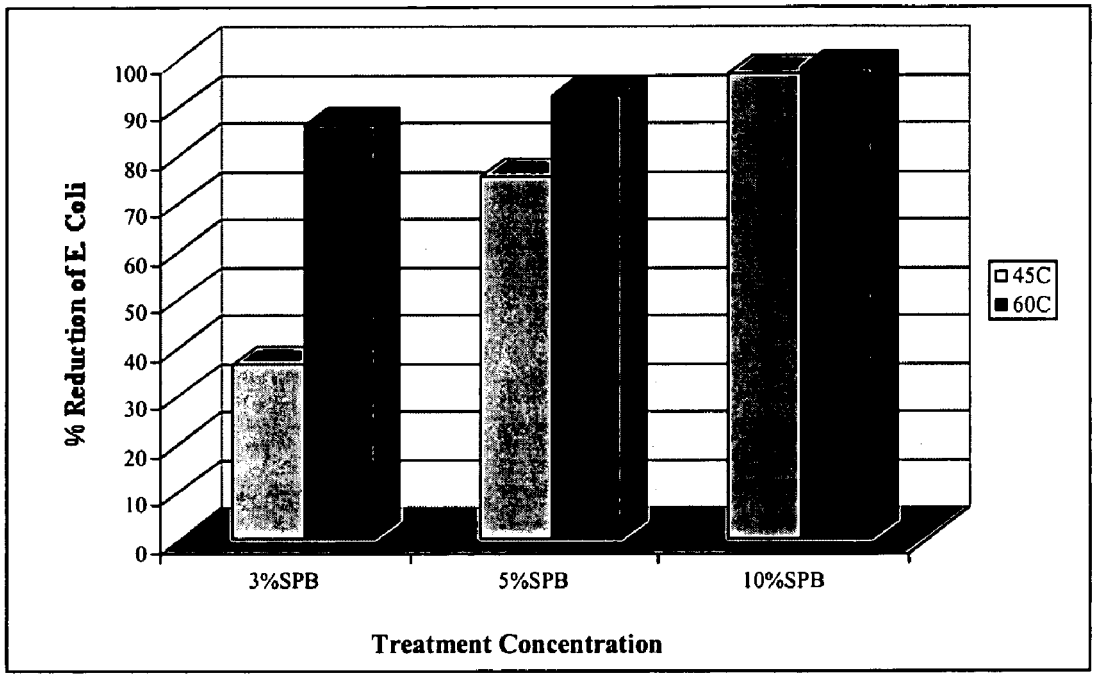
FIG. 10 illustrates the biocidal efficacy of 6% BTCA cotton treated with SPB at 10 min.

Similar to the observation made from the effect of increased sodium perborate concentration, the percentage reduction of *Escherichia coli* increased as the treatment concentration was increased (FIG. 10).

As seen earlier, treatment temperature showed to affect the percentage reduction of *Escherichia coli* on the modified cellulose. At all three concentrations, the samples that were treated at a higher temperature of 60° C. showed superior biocidal effects than those treated at 45° C. (FIG. 10). At the highest concentration of 10%, samples that were treated at both temperatures exhibited the highest percentage reduction of *Escherichia coli*. This is consistent with the findings from the chemical titration analysis. An increased amount of sodium perborate present in the treatment solution generated an increase in perhydroxyl anions in the treatment solution, which then, led to an increase in peroxyacid formation. This contributed to the increase in oxidative potentials, which subsequently resulted in the enhanced biocidal properties of the modified cellulose.

Figure 11:
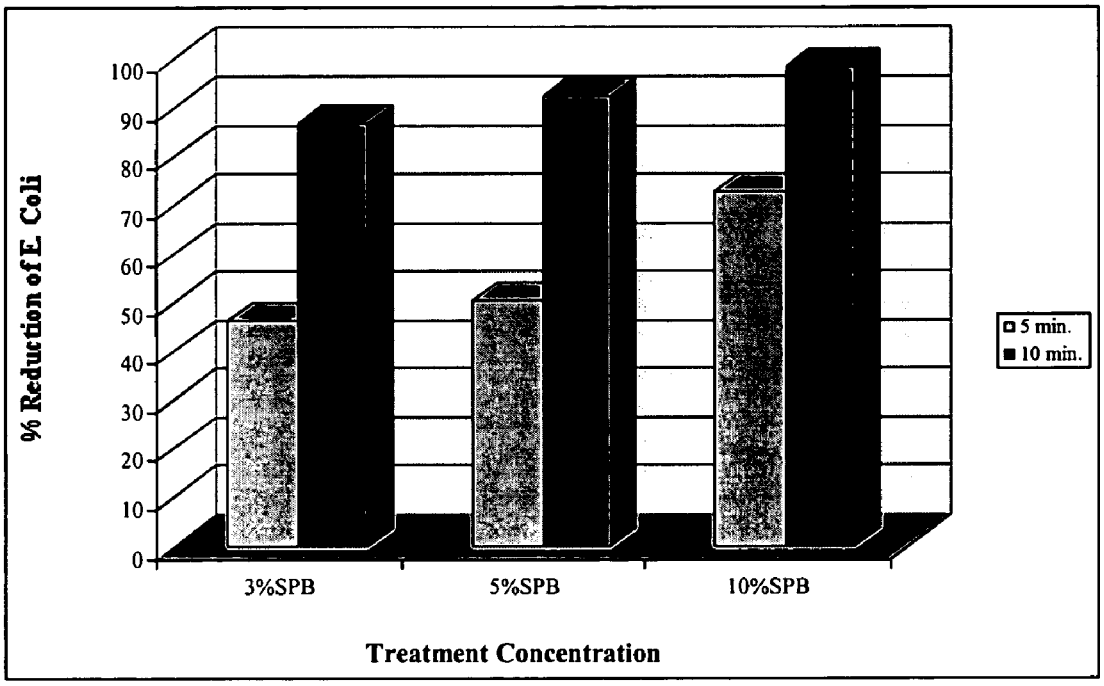
FIG. 11 illustrates the biocidal efficacy of 6% BTCA cotton treated with SPB at 60° C.

Further, prolonged treatment time resulted in improved biocidal properties of the modified cellulose. At 60° C., as the treatment time was extended from 5 to 10 min. at all three concentrations, the percentage reduction of *Escherichia coli* also increased (FIG. 11). This however, is least pronounced at the 10% SPB level.

Figure 12:
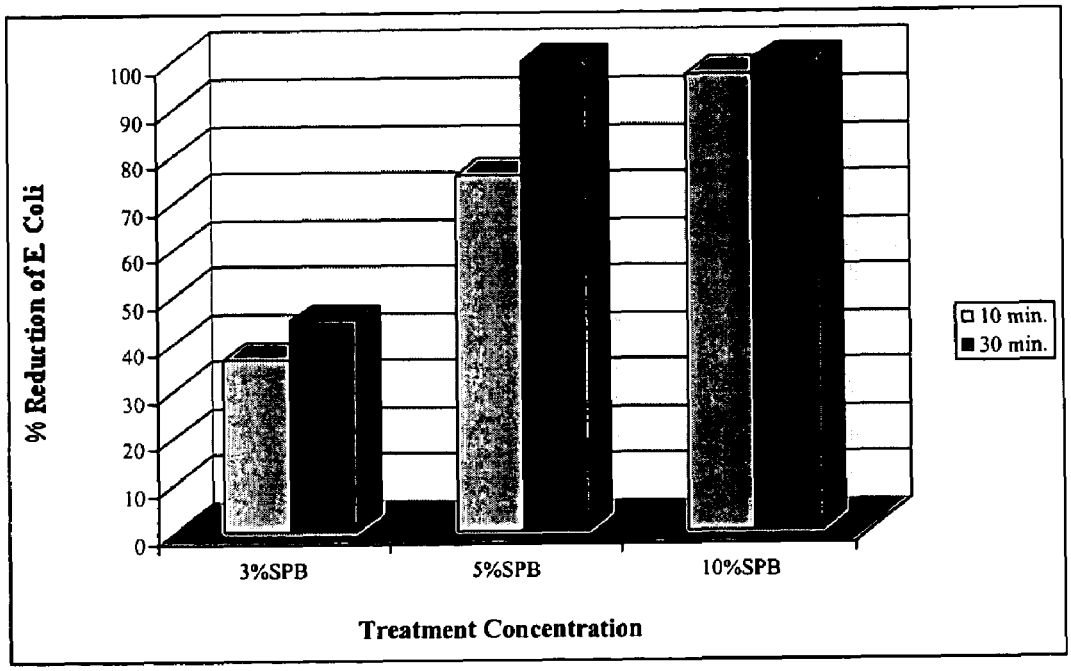
FIG. 12 illustrates the biocidal efficacy of 6% BTCA cotton treated with SPB at 45° C.

A similar trend is observed at 45° C. As the treatment time was extended from 10 min. to 30 min., the percentage reduction of *Escherichia coli* was increased at all three concentration levels (FIG. 12). This effect is most pronounced at the 5% SPB level. At the extended treatment time of 30 min., the samples modified with 5% SPB exhibited biocidal properties equivalent to that of those modified with 10% SPB.

Figure 13:
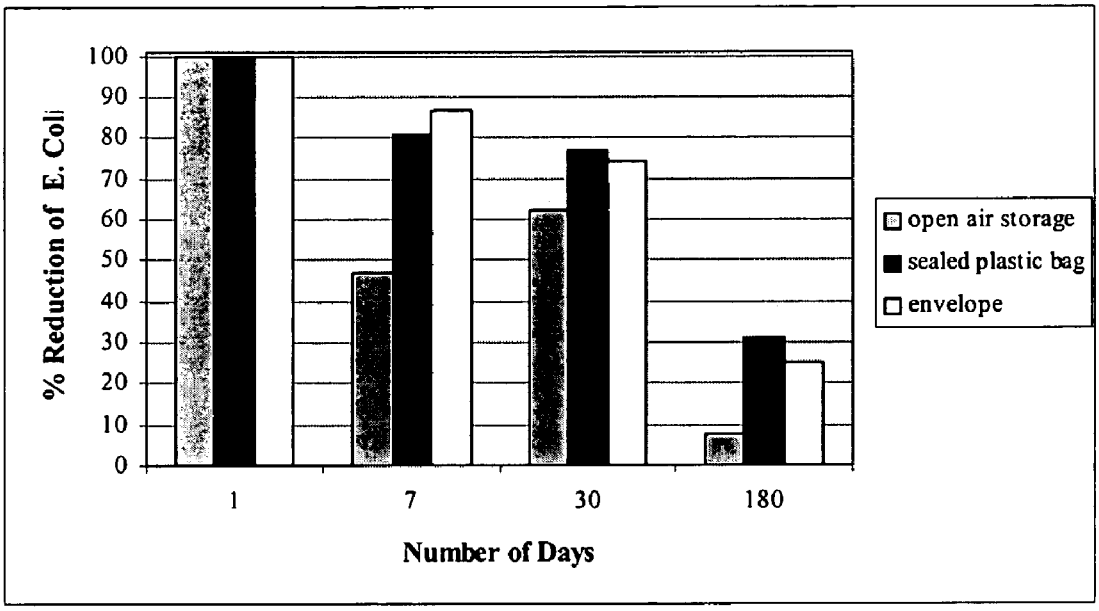
FIG. 13 illustrates the biocidal properties of modified cellulose with SPB over periods of storage time.

After establishing the biocidal properties of this modified cellulose, the stability of such function of the samples was examined. Modified cellulose samples that were treated with 6% BTCA, 10% sodium perborate at 45° C. for 30 min., were stored at constant temperature and humidity over at one day, one week, one month and six months before they were tested against *Escherichia coli*. Three different storage methods were employed: open-air, sealed plastic bag and paper envelope. The biocidal properties of samples stored under all three methods decreased over time (FIG. 13). The most substantial decrease was evident with samples stored in open-air, whereas samples stored in an unsealed paper envelope exhibited highest retention after one week. After which, samples that were stored in a sealed plastic bag showed highest retention over one and six-month periods. In comparison, open-air storage allowed for exposure to light, temperature and moisture, which may affect the stability of the peroxyacid structure formed on the modified cellulose.

Figure 14:
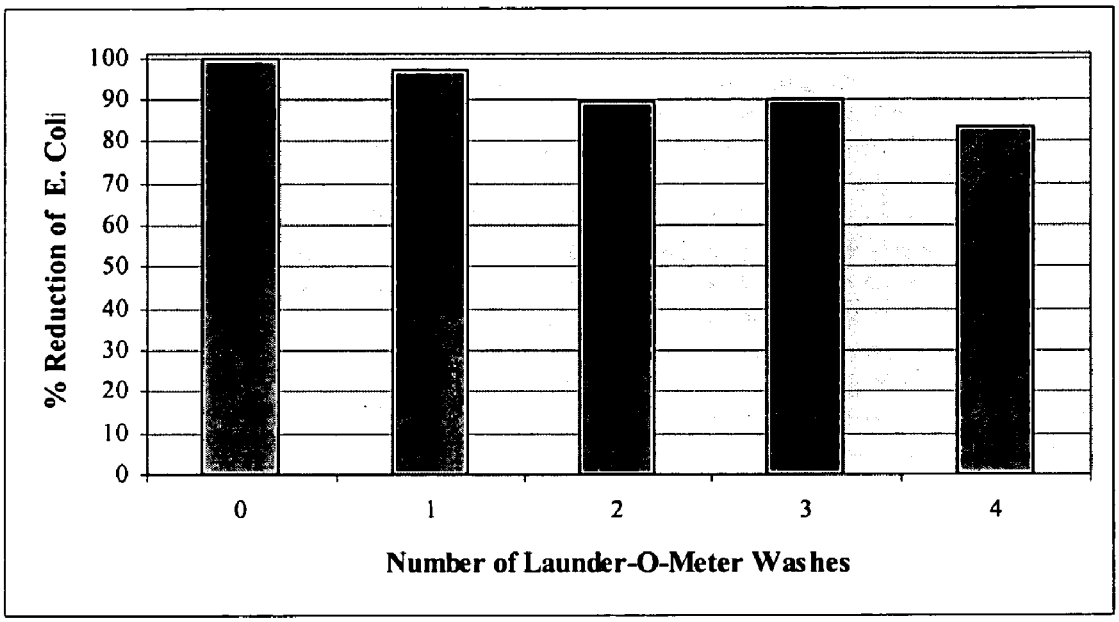
FIG. 14 illustrates the effect of laundering on the biocidal efficacy of 6% BTCA cotton treated with 10% SPB at 45° C., 30 min.

In order to investigate the durability of the function of this modified cellulose and its relative biocidal properties, a series of laundering tests were carried out. Cotton samples that were treated with 6% BTCA and further modified with 10% sodium perborate at 45° C. for 30 min. were subjected to repeated laundering tests in a Launder-O-Meter® at room temperature. Due to the intensified impact exerted by the Launder-O-Meter®, each wash is equivalent to five domestic machine washes. After each wash, the samples were subjected to *Escherichia coli* for biocidal activities, repeated up to five cycles (FIG. 14).

Figure 15:
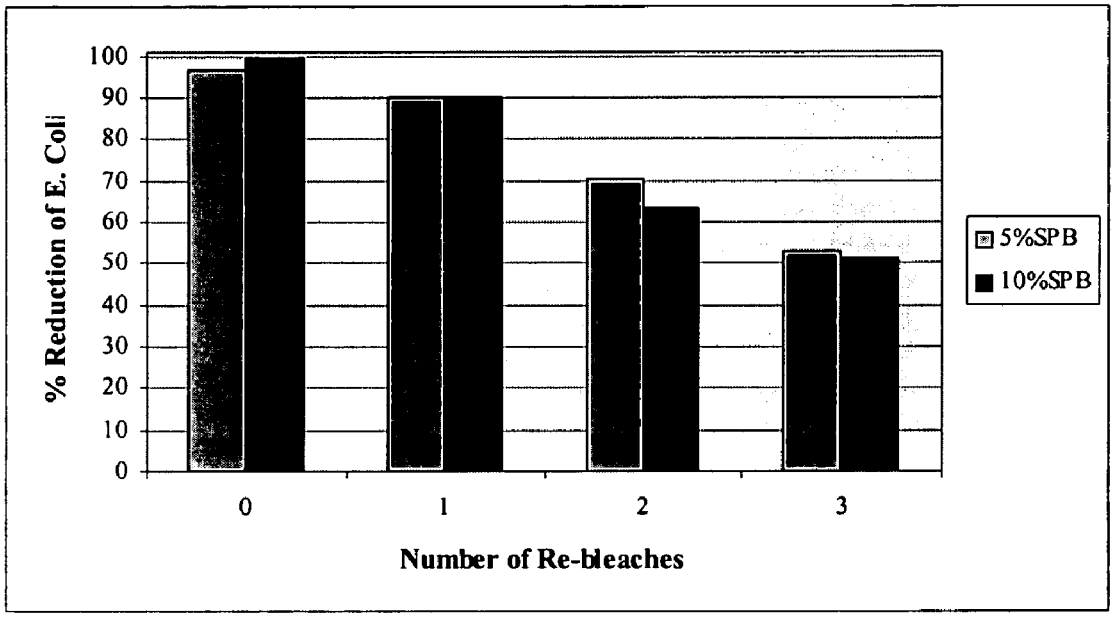
FIG. 15 illustrates the effect of laundering and rebleaching on the biocidal efficacy of 6% BTCA cotton treated with SPB at 45° C., 30 min.

Samples that were not laundered at all demonstrated over 99% reduction of *Escherichia coli*. This level of percentage reduction gradually decreased as the samples were subjected to additional washing, finally dropping to 85% after four washes. (FIG. 15.)

In addition to the physical impact from laundering on the tested samples, the effect of sterilization may also induce further damage to these tested fabrics. After each cycle of anti-bacterial test, all glassware, equipment and samples were sterilized before subsequent use or re-treatment. Since the sterilization took place at high temperature and pressure (over 100° C., 20 psi), additional severe structural damages could be induced on the samples. To verify this, a series of tests comparing the effects of sterilization and the relative biocidal properties were conducted.

Figure 16:
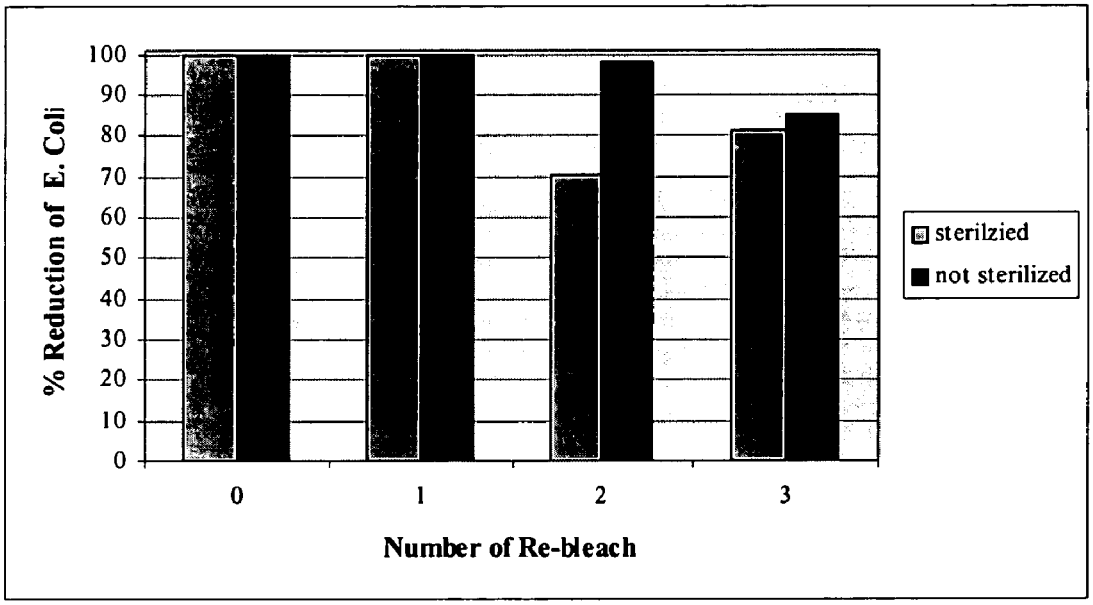
FIG. 16 illustrates the effect of sterilization on the biocidal efficacy of 6% BTCA cotton treated with 5% SPB at 45° C., 30 min.
Figure 17:
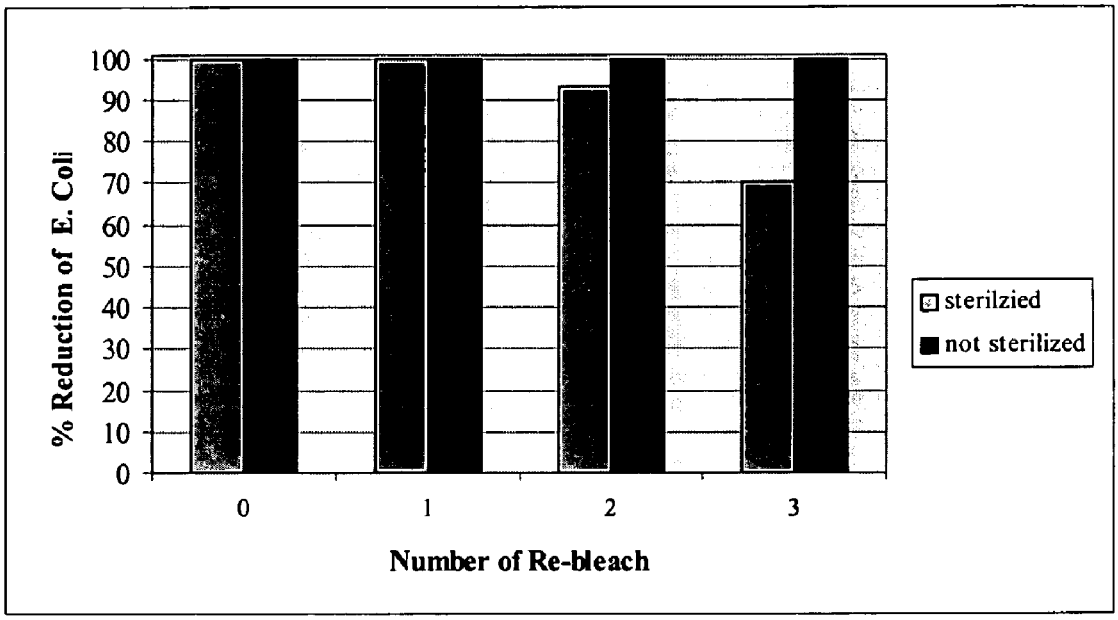
FIG. 17 illustrates the effect of sterilization on the biocidal efficacy of 6% BTCA cotton treated with 10% SPB at 45° C., 30 min.

Results show that at both 5% and 10% SPB levels, non-sterilized samples retained relatively higher biocidal properties compared to those that were sterilized, rebleached and re-tested (FIGS. 16–17). In particular, samples that were treated and retreated with 10% sodium perborate maintained relatively consistent level of biocidal properties even after four cycles (FIG. 17). In comparison, at 5% SPB, after the fourth cycle, the percentage reduction of *Escherichia coli* of the non-sterilized samples was not substantially different from that of the sterilized samples (FIG. 16).

FT-IR Analysis of BTCA-Treated Cellulose Modified with Sodium Perborate

Figure 18:
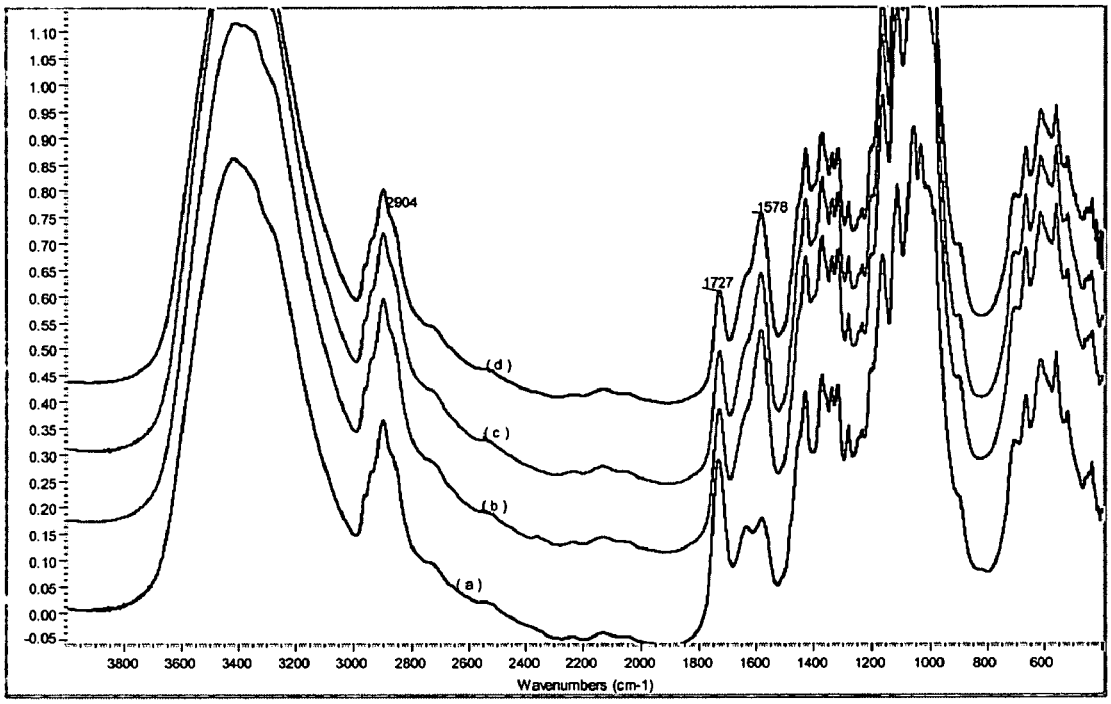
FIG. 18 illustrates the FT-IR spectra of 6% BTCA-cotton treated with (a) 6% BTCA, (b) 3% SPB, (c) 5% SPB and (d) 10% SPB at 45° C., 10 min.
Figure 19:
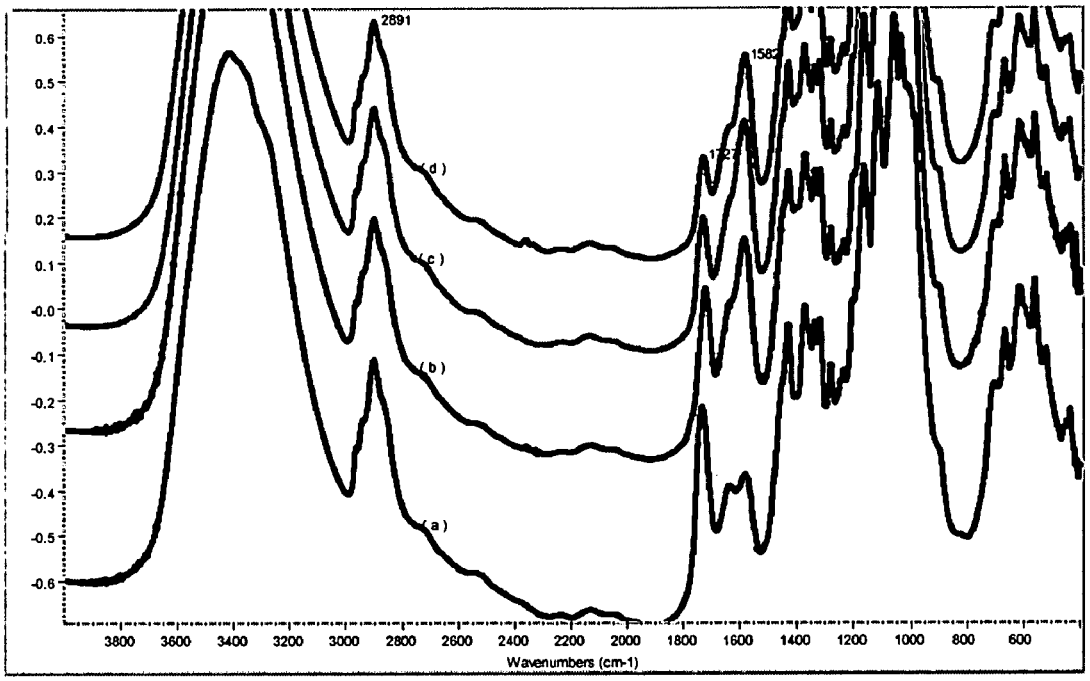
FIG. 19 illustrates the FT-IR spectra of 6% BTCA-cotton treated with (a) 6% BTCA only, (b) 3% SPB, (c) 5% SPB, and (d) 10% SPB at 60° C., 10 min.

The FT-IR analysis of 6% BTCA-treated cellulose treated with sodium perborate showed that as the SPB concentration was increased from 1% to 10%, the intensities of the respective ester bands at 1727 $cm^{-1}$ seemingly decreased (FIG. 18). This trend is even more apparent as the treatment temperature was raised to 60° C. (FIG. 19). These observations are in agreement with internal ester hydrolysis that led to the cleavage of the ester bond in between BTCA and cellulose.

Figure 20:
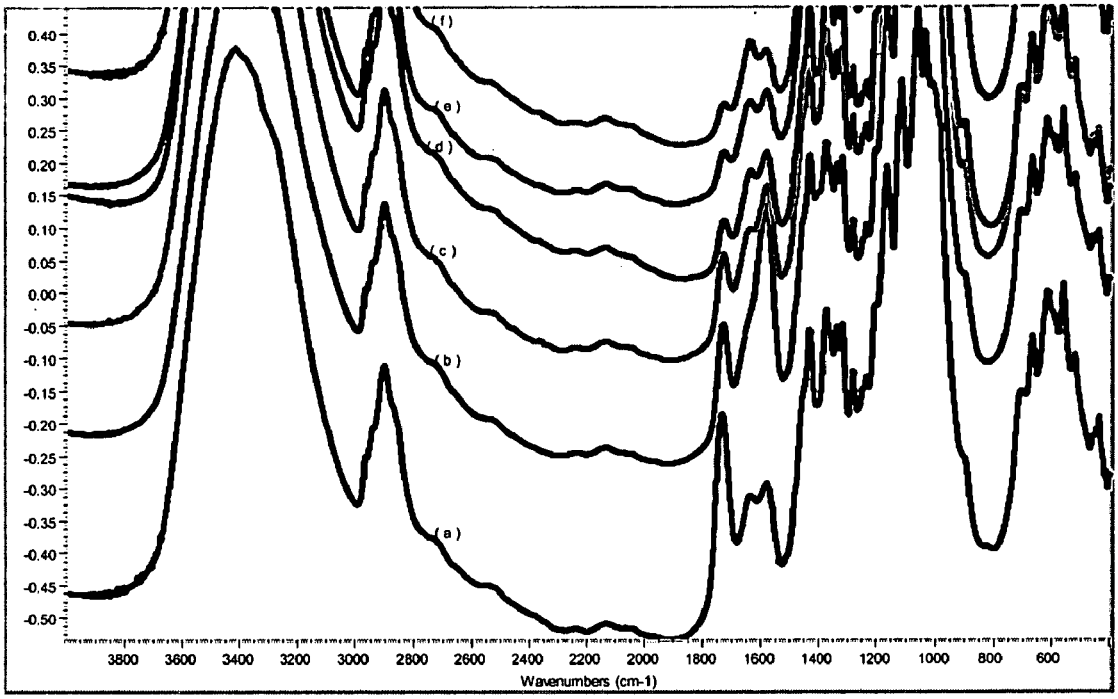
FIG. 20 illustrates the FT-IR spectra of 6% BTCA-cotton treated with (a) 6% BTCA only, (b) 10% SPB, 0 wash, (c) 1 wash, (d) 2 washes, (e) 3 washes, (f) 4 washes at 45° C., 30 min. and sterilized.
Figure 21:
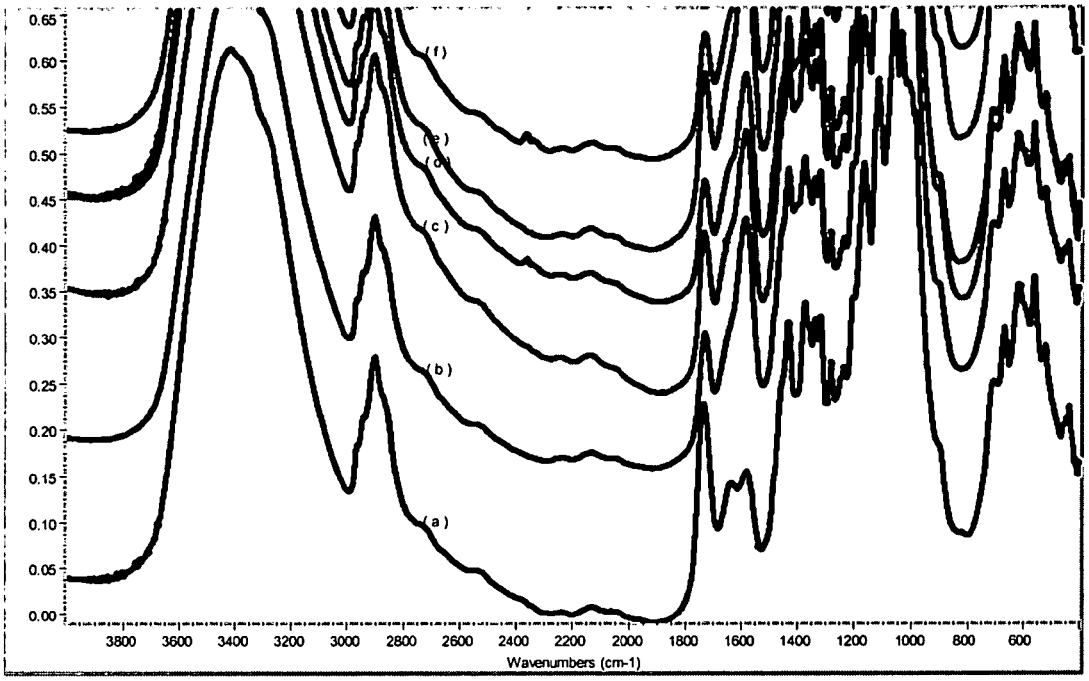
FIG. 21 illustrates the FT-IR spectra of 6% BTCA-cotton treated with (a) 6% BTCA only, (b) 10% SPB, 0 wash, (c) 1 wash, (d) 2 washes, (e) 3 washes, (f) 4 washes at 45° C., 30 min., not sterilized.

Repeated laundering also shows to be interrelated to the change in ester band intensity. FIG. 20 shows that the ester band intensities gradually decreases after each laundering with sterilization. This is in agreement with the earlier finding that laundering induces physical impact in the loss of BTCA as well as the peroxyacid moieties on cellulose. Consequently, reducing the oxidative potential and biocidal effectiveness on the treated fabrics. On the other hand, the ester band intensities of the samples that were laundered repeatedly, but not sterilized, showed a less drastic change (FIG. 21). The intensities were retained at similar levels, substantiating the earlier finding on the damage of sterilization has on the laundered samples and the crosslinkages. Thus, the modified properties could be retained for more cycles.

Figure 22:
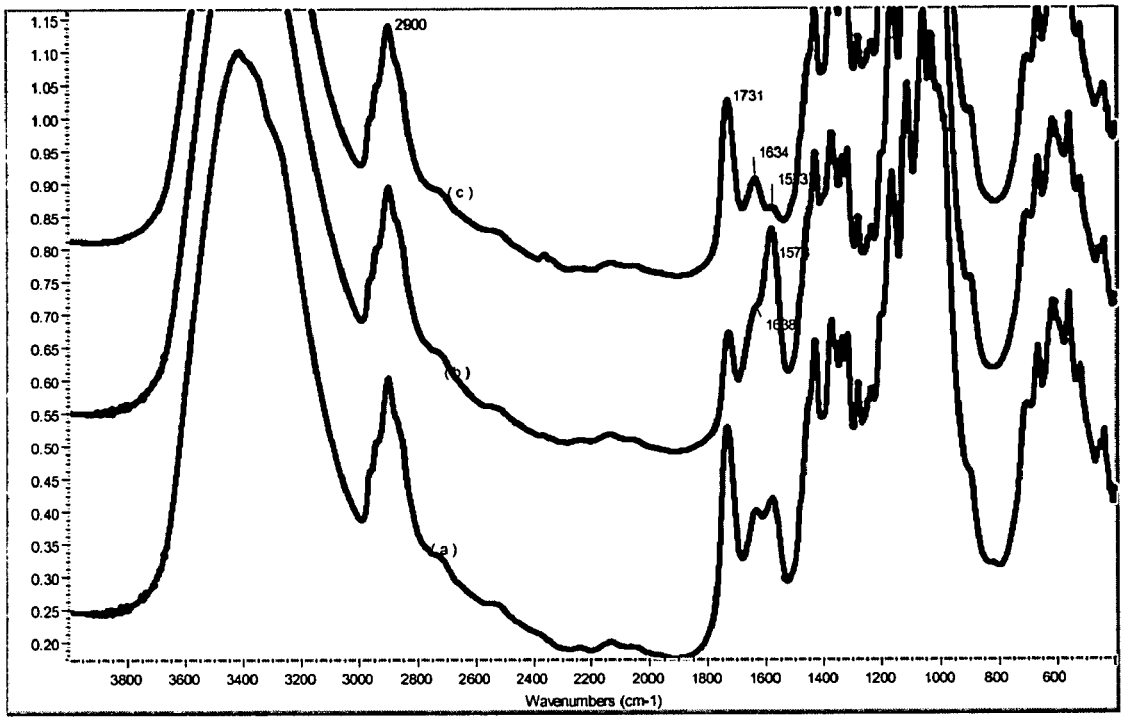
FIG. 22 illustrates the FT-IR spectra of 6% BTCA-cotton treated with (a) 6% BTCA only, (b) 3% SPB, and (c) 3% $H_2O_2$ at 60° C., 10 min.

Moreover, since the peroxyacid formation on BTCA-treated cellulose under alkaline condition has been observed to differ from that under acidic condition, the resulted chemical structures would be different also. This contrast in chemical structures could be seen in FIG. 22. Under acidic condition, peroxyacid formation on cellulose proceeded in the presence of an acid catalyst in a nucleophilic attack; under alkaline condition, the reaction proceeded by way of ester hydrolysis. The loss of BTCA crosslinking via ester hydrolysis could be seen through the diminished ester peak at 1727 $cm^{-1}$.

Figure 23:
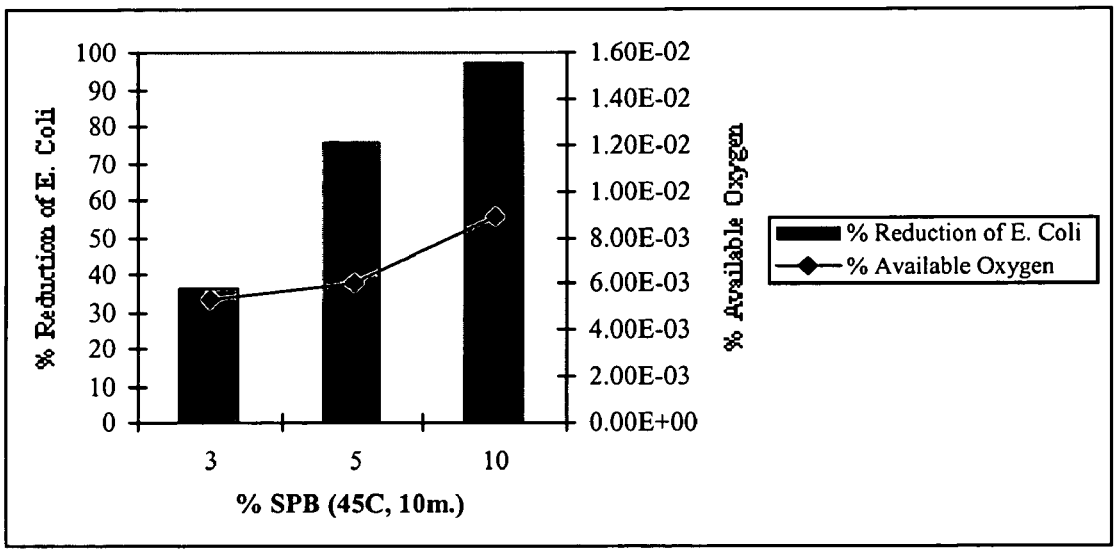
FIG. 23 illustrates the percentage available oxygen and relative biocidal efficacy of 6% BTCA cotton treated with SPB at 45° C., 10 min.

Since the biocidal properties of the modified cellulose are closely related to the amount of active oxygen on the fabrics, attempts in drawing the correlation between the two were carried out. As shown in FIG. 23, at the lower treatment temperature of 45° C., it was found that in order to attain a high percentage (over 90%) reduction of *Escherichia coli*, the percentage available oxygen on the modified fabrics had to be over 0.009% (10% SPB). To obtain over 70% reduction of *Escherichia coli*, the percentage available oxygen had to be at the 0.006% level (5% SPB). Below 0.006% available oxygen would only reduce under 40% of *Escherichia coli* (3% SPB).

Figure 24:
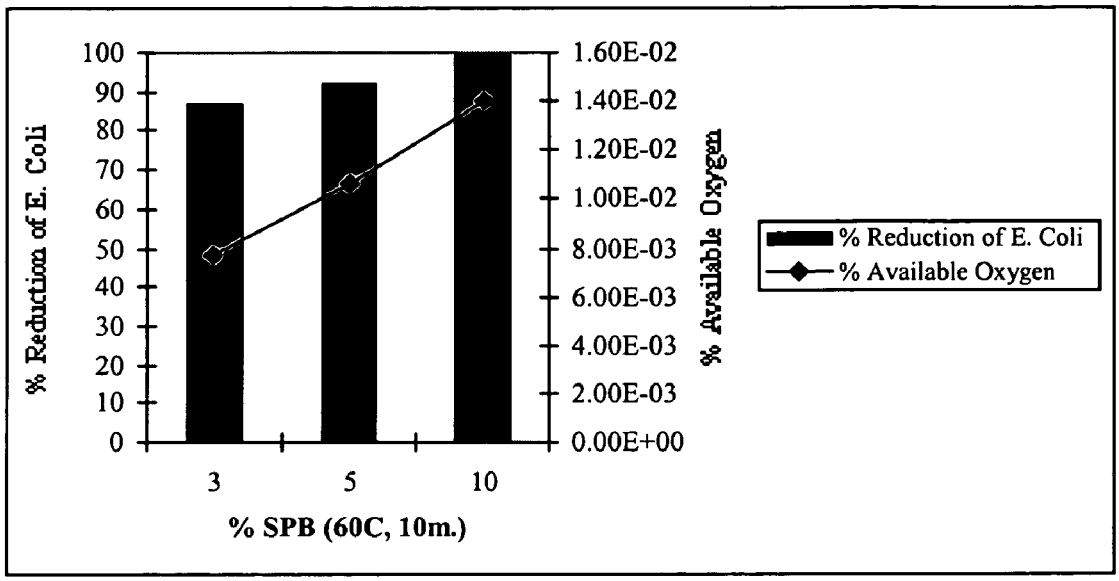
FIG. 24 illustrates the percentage available oxygen and relative biocidal efficacy of 6% BTCA cotton treated with SPB at 65° C., 10 min.

The correlation seems to slightly differ at the higher treatment temperature of 60° C. (FIG. 24). Over 80% reduction of *Escherichia coli* was attained at 0.008% available oxygen level (3% SPB). To attain over 90% reduction of *Escherichia coli*, the percentage available oxygen was found to be over 0.01% (5% SPB); in order to attain over 99% reduction of *Escherichia coli*, the relative percentage available oxygen was found to be over 0.014% (10% SPB). Although the correlations at the two different temperatures are slightly different, it is evident that in order to attain over 95% reduction of *Escherichia coli*, the corresponding available oxygen on the modified samples has to be over 0.01%. This would be an indicative active oxygen level for similar modification approach in attaining effective biocidal properties.

References cited in this application are listed as follows: Ainsworth, S. J. (1995) *Chem. Eng. News* 74 (23 January), 30–53; American Association of Textile Chemists and Colorists. (1997) *Tehnical Manual*. Research Triangle, NC: AATCC Press; Andrews, D. H. and Singh, R. P. (1979) Peroxide Bleaching. *The Bleaching of Pulp,* 3rd Edition, (R. P. Singh, ed.) Atlanta: Tappi Press, pp. 211–253; Anis, S. S. (2000) *Transition Metal Chemistry,* 25: 224+226; Cotton, F. A., Wilkinson, G. (1988) *Advanced Inorganic Chemistry*. New York: Wiley; Fujiwara, M., Tamura, T., and Akabane, Y. (1995) *Journal of America Oil Chemists Society,* 72 (1): 97–103; Grime, K. and Clauss, A. (1990) *Chemistry & Industry,* 15 October: pp. 647–651; Henrandez, O. et al. (1994) *Journal of Hazardous Materials,* 39 (2): 161; Karunakaran, C., Anandhy, K., and Ramachandran V. (2000) *Monatshefte für Chemie,* 131: 1025–1029; Kubota, H., Kondo, T., Ichikawa, T., and Katakai, R. (1997) *Polymer Degradation and Stability,* 60: 425–430; Minning, S., Weiss, A., Bornscheuer, U. T., and Schmid, R. D. (1999) *Analytica Chimica Acta,* 378: 293–298; Morrow, N., Ramsden, C. A., Sargent, B. J., and Wallett, C. D. (1998) *Tetrahedron,* 54: 9603–9612; Muzart, J. (1995) *Synthesis,* 1325; Nongkunsarn, P. and Ramsden, C. A. (1997) *Tetrahedron,* 53 (10): 3805–3830; OSHA. (1987) Formaldehyde in the Workplace. *OSHA Regulations*. Washington, D.C.: OSHA; Perkins, W. S. (1996) *Textile Coloration and Finishing*. Durham, N.C.: Carolina Academic Press; Schramm, C. and Rinderer, B. (2000) *Textile Chemist and Colorist & American Dyestuff Reporter,* 32 (4): 50–54; Shank, D. (2002) *AATCC Review,* 2 (3): 29–32; Sun, G. and Xu, X. (1998) *Textile Chemist and Colorist,* 30 (6) 26–30; Sun, G. and Xu. X. (1999) *Textile Chemist and Colorist,* 31 (1): 21–24; Sun, G. and Xu, X. (1999) *Textile Chemist and Colorist,* 31 (5): 31–35; Suznjevic, D., Blagojevic, S., Vucelic, D., and Zuman, P. (1997) *Electroanalysis,* 9 (11):861–864; Varennes, S., Daneault, C. and Parenteau, M. (1996) *Tappi Journal,* 79 (3): 245–250; Vigo, T. (1994) *Textile Processing and Properties*. Amsterdam: Elsevier Science; Week, M. (1989) *Book of Papers International Conference and Exhibition*, American Association of Textile Chemists and Colorists; and Yüksel, G. Y., Titiz, S., and Bulutou, A. N. (1996) *J. Chem. Eng. Data,* 41: 586–588.

It is understood that the examples and embodiments described herein are for illustrative purposes only and that various modifications or changes in light thereof will be suggested to persons skilled in the art and are to be included within the spirit and purview of this application and scope of the appended claims. All publications, patents, and patent applications cited herein are hereby incorporated by reference in their entirety for all purposes.

What is claimed is:

1. A fibrous composition, said fibrous composition comprising:

a fiber; and a peroxycarboxylic acid functional group covalently attached to said fiber wherein said peroxycarboxylic acid functional group is derived from an organic acid having at least two carboxyl groups.

2. The fibrous composition according to claim 1, wherein said fiber is a member selected from the group consisting of a natural material and a material derived from natural material.

3. The fibrous composition according to claim 2, wherein said natural material comprises a member selected from the group consisting of cellulose, starch, chitosan, chitin, wool, and silk.

4. The fibrous composition according to claim 3, wherein said cellulose is a member selected from the group consisting of cotton, rayon, tencel, flax, hemp, and blends of the fibers with polyester and nylon.

5. The fibrous composition according to claim 1, wherein said fiber comprises polyvinyl alcohol.

6. The fibrous composition according to claim 1 wherein said organic acid is a member selected from the group consisting of a tetracarboxylic acid, a tricarboxylic acid and a dicarboxylic acid.

7. The fibrous composition according to claim 1, wherein said fiber has a plurality of peroxycarboxylic acid functional groups.

8. The fibrous composition according to claim 1, wherein said organic acid is a member selected from the group consisting of butane tetraacetic acid, citric acid and maleic acid.

9. The fibrous composition according to claim 8, wherein said fiber has at least two free carboxylic acid functions.

10. A process for preparing an antimicrobial fiber, said process comprising:

(a) immersing a fiber in an aqueous treating solution comprising an organic acid, wherein said organic acid has at least two carboxyl groups; and (b) treating said fiber with an oxidizing agent to produce a peroxycarboxylic acid function, thereby preparing an antimicrobial fiber.

11. The process according to claim 10, wherein said treating solution further comprises a catalyst.

12. The process according to claim 11, wherein said catalyst is selected from the group consisting of an acid catalyst and a basic catalyst.

13. The process according to claim 11, wherein said acid catalyst is a member selected form the group consisting of sulfuric acid, methanesulfonic acid and sulfonic acid.

14. The process according to claim 11, wherein said catalyst is an ion-exchange resin.

15. The process according to claim 11, wherein said catalyst is a member selected from the group consisting of sodium hydroxide and potassium hydroxide.

16. The process according to claim 10, wherein said organic acid is a member selected from the group consisting of butane tetraacetic acid and citric acid.

17. The process according to claim 10, further comprising:

removing the excess treating solution from said fiber prior to treating said fiber with an oxidizing agent.

18. The process according to claim 10, wherein said oxidizing agent is an aqueous solution of hydrogen peroxide.

19. The process according to claim 18, wherein said hydrogen peroxide is about 0.5% to about 30% by weight.

20. The process according to claim 10, wherein said oxidizing agent is an oxygen bleach.

21. The process according to claim 20, wherein said oxygen bleach is a member selected from the group consisting of hydrogen peroxide and sodium perborate.

22. The process according to claim 10, wherein said fiber is an article.

23. The process according to claim 22, wherein said article is a member selected from the group consisting of a surgeon's gown, a cap, a mask, a surgical cover, a patient drape, a carpeting, a bedding material, an underwear, a sock, a bandage, a pad, a sheet, and a uniform.

24. The process according to claim 10, wherein said fiber is cellulosic material.

25. The process according to claim 24, wherein said cellulosic material is a member selected from the group consisting of cotton, rayon, tencel, flax, hemp, and blends of the fibers with polyester or nylon.

26. The process according to claim 10, wherein said fiber is selected from the group consisting of chitosan and chitin material.

27. The process according to claim 10, wherein said antimicrobial activity is regenerable.

* * * * *

UNITED STATES PATENT AND TRADEMARK OFFICE

CERTIFICATE OF CORRECTION

PATENT NO. : 6,962,608 B1
APPLICATION NO. : 10/674764
DATED : November 8, 2005
INVENTOR(S) : Sun et al.

It is certified that error appears in the above-identified patent and that said Letters Patent is hereby corrected as shown below:

On page 2 of the references, in the left-hand column, under Cho, in the first line of the entry, “functiion” should be --function--.

In the same column, under Kim et al. (first occurrence), in the first line of the entry, “salls” should be --salts--.

In the left-hand column under Kim et al. (second occurrence), in the second line of the entry, “quatemary” should be --quaternary--.

In the right-hand column of page 2 of the references, under Scott et al., in the second line of the entry, “vis” should be --via--.

Signed and Sealed this

Twenty-fifth Day of July, 2006

JON W. DUDAS
*Director of the United States Patent and Trademark Office*